US007296457B2

(12) United States Patent
Morehead et al.

(10) Patent No.: US 7,296,457 B2
(45) Date of Patent: Nov. 20, 2007

(54) THERMALLY-ACTUATED PRESS BRAKE TOOL HOLDER TECHNOLOGY

(75) Inventors: John H. Morehead, White Bear Lake, MN (US); Heath E. Harrington, Lancaster, PA (US)

(73) Assignee: Wilson Tool International Inc., White Bear Lake, MN (US)

( * ) Notice: Subject to any disclaimer, the term of this patent is extended or adjusted under 35 U.S.C. 154(b) by 353 days.

(21) Appl. No.: 10/876,886

(22) Filed: Jun. 25, 2004

(65) Prior Publication Data

US 2005/0284206 A1 Dec. 29, 2005

(51) Int. Cl.
*B21D 37/04* (2006.01)

(52) U.S. Cl. ..... 72/481.1; 72/481.2; 72/482.2; 60/527; 60/530

(58) Field of Classification Search ..... 72/482.1, 72/482.2, 482.3, 482.4, 482.6, 481.1, 481.2; 269/216, 20; 60/516–531
See application file for complete search history.

(56) References Cited

U.S. PATENT DOCUMENTS

| | | | | |
|---|---|---|---|---|
| 4,612,796 | A | 9/1986 | Smyth, Jr. | |
| 4,721,293 | A | 1/1988 | Schron et al. | |
| 4,895,014 | A * | 1/1990 | Houston | 72/481.2 |
| 4,993,255 | A | 2/1991 | Treillet | |
| 5,511,407 | A | 4/1996 | Kawano | |
| 5,513,514 | A | 5/1996 | Kawano | |
| 5,562,892 | A | 10/1996 | Kirk et al. | |
| 5,572,902 | A | 11/1996 | Kawano | |
| 5,685,149 | A | 11/1997 | Schneider et al. | |
| 5,720,169 | A | 2/1998 | Schneider | |
| 5,822,989 | A | 10/1998 | Sturdevant et al. | |
| 6,003,360 | A | 12/1999 | Runk et al. | |
| 6,109,602 | A | 8/2000 | Schron, Jr. et al. | |
| 6,151,951 | A | 11/2000 | Kawano | |
| 6,241,231 | B1 | 6/2001 | Schron, Jr. et al. | |
| 6,467,327 | B1 * | 10/2002 | Runk et al. | 72/481.1 |
| 6,481,204 | B1 | 11/2002 | Yuschak et al. | |
| 6,522,953 | B1 | 2/2003 | Schneider | |
| 6,564,611 | B2 | 5/2003 | Harrington et al. | |
| 7,021,116 | B2 | 4/2006 | Harrington | |
| 7,096,708 | B2 | 8/2006 | Gascoin | |

FOREIGN PATENT DOCUMENTS

| | | |
|---|---|---|
| EP | 0 644 002 B1 | 3/1999 |
| EP | 1 366 832 | 12/2003 |
| WO | WO 2004/024361 | 3/2004 |

OTHER PUBLICATIONS

TCAM Power Workholding LLC's 2001 TCAM T-Vice Operator's Manual, 1-21.

* cited by examiner

*Primary Examiner*—Dmitry Suhol
(74) *Attorney, Agent, or Firm*—Fredrikson & Byron, P.A.

(57) ABSTRACT

The invention provides press brake technology. In more detail, the invention involves a press brake tool holder having a thermally-responsive actuator. In certain embodiments, the actuator comprises a thermally-expandable polymer and/or a shape-memory alloy.

38 Claims, 17 Drawing Sheets

THERMALLY-ACTUATED PRESS BRAKE TOOL HOLDER TECHNOLOGY

FIELD OF THE INVENTION

The present invention relates generally to industrial presses. More particularly, this invention relates to press brakes.

BACKGROUND OF THE INVENTION

Press brakes are commonly used to bend or otherwise deform sheet-like workpieces, such as sheet metal. A conventional press brake has an upper beam and a lower beam, at least one of which is movable toward and away from the other. Typically, the upper beam is movable vertically while the lower beam is fixed in a stationary position. It is common for a male forming punch and a female forming die to be mounted respectively on the upper and lower beams of a press brake.

Typically, the punch has a downwardly-oriented, workpiece-deforming surface (or "tip"). The configuration of this surface is dictated by the shape into which it is desired to deform a workpiece. The die typically has a recess, bounded by one or more workpiece-deforming surfaces, that is aligned with the tip of the punch. The configuration of this recess corresponds to the configuration of the punch's tip. Thus, when the beams are brought together, a workpiece between them is pressed by the punch into the die to give the workpiece a desired deformation (e.g., a desired bend).

From time to time, it is necessary to exchange punches and dies to accommodate different bending operations. The manner in which punches and dies are mounted on, and dismounted from, a press brake depends upon the particular style of tool holder/tooling being used. In some cases, the tool holder has a clamp that can be actuated to close securely upon (i.e., to clamp on) the tang of a press brake tool. In many cases, the clamp holds the tool's tang against a horizontally elongated wall (or "bed") of the upper or lower beam. When the clamp is loosened, the tool can be removed. In certain instances, the tool can be removed by moving it vertically out of the clamp. In other instances, the tool must be removed by sliding it horizontally out of the clamp.

Many press brake tool holders have been devised. Some employ clamps that are actuated mechanically. Others employ clamps that are actuated hydraulically. Exemplary tool holders of both types will now be described.

U.S. Pat. No. 4,993,255 (issued to Treillet), the entire contents of which are incorporated herein by reference, discloses a tool holder that is attached by means of a C clamp to the bed of the upper table. Through use of a camming mechanism, the upwardly extending shank of a tool is captured between a pivotable clamp and a portion of the holder, the shank and clamp having cooperating surfaces enabling the tool to be readily inserted in the holder. In this patent, a locking cam is disclosed for locking the clamp against the tool.

U.S. Pat. Nos. 5,513,514, 5,511,407, and 5,572,902 (each issued to Kawano), and European patent publication 0 644 002 A2, the entire contents of each of which are incorporated herein by reference, all show tool holders in which a pivoting clamp is employed to secure the shank of a tool against the mounting plate of a tool holder. In each of these patents, the tool holder is equipped with a threaded mechanism operated by a lever that pivots from side to side to lock and unlock the clamp, force being transmitted from the lever to the clamp via a spring structure.

U.S. Pat. No. 6,003,360 (issued to Runk et al.), the entire contents of which are incorporated herein by reference, provides a particularly advantageous press brake tool holder. The tool holder includes a clamp that opens to a position allowing manual removal of the tool while preventing the tool from falling. The clamp in certain preferred embodiments is actuated with a manual lever.

U.S. Pat. No. 6,151,951 (issued to Kawano), the entire contents of which are incorporated herein by reference, discloses a tool holder having multiple hydraulically actuated pistons that transmit force generated by hydraulic fluid to a clamp. The pistons are displaced outwardly to force the clamp shut.

U.S. Pat. No. 6,564,611 (issued to Harrington et al.), the entire contents of which are incorporated herein by reference, discloses particularly advantageous hydraulic press brake tool holders. The press brake tool holders are configured for releasing and securing press brake tools in response to applied fluid pressure. One disclosed tool holder includes a horizontally-elongated body having a cam shaft bore disposed longitudinally therethrough, and receiving a slidably and sealingly mounted cam shaft therein. The cam shaft can have at least one axial camming surface, having a large outer diameter region axially tapered to a small outer diameter region, and in contact with a cam follower pin slidably disposed in a cam follower pin bore transversely disposed through the body. The cam follower pin can bear against a pivotally mounted clamp disposed about the body. In response to applied fluid pressure, the camming surface can slide axially, thereby increasing the effective outer diameter as seen by the cam follower pin, urging the cam follower pin outward and against the upper portion of the pivotally mounted clamp, and closing the lower clamp portion about a press brake tool.

Insofar as mechanically-actuated tool holders are concerned, a press brake operator generally moves a handle of the tool holder manually to actuate the clamp. While tool holders of this nature are entirely acceptable in most cases, it would be desirable to provide a tool holder in which clamping and unclamping can be performed without requiring an operator to manually move a handle.

Hydraulic tool holders also have limitations. For example, hydraulic tool holders may require cumbersome hydraulic hoses, expensive hydraulic power supplies, and control valves. Such bulky hydraulics tend to render hydraulic clamps difficult to use. Moreover, these clamps tend to have hydraulic fluid leaks, which can contaminate cutting fluids as well as the environment. Hydraulic clamps also tend to have relatively high maintenance costs and relatively high noise levels.

Pneumatic clamps would also have shortcomings. For example, pneumatic clamps would tend to have high noise levels. Pneumatic systems may also release oil mist into the air, creating a "shop air" smell. Further, pneumatic systems tend to require expensive compressors, filter/regulator packages, and maintenance. Moreover, pneumatic clamps may be limited in terms of clamping force.

Finally, in certain automated machining processes, it may be desirable to move a tool holder among one or more machining stations. This type of movement would tend to be cumbersome with hydraulic or pneumatic systems.

The present invention provides a new and improved press brake tool holder, which overcomes the above-noted problems and others.

SUMMARY OF THE INVENTION

In certain embodiments, the invention provides a press brake tool holder and a press brake tool, in combination. The tool has generally opposed first and second ends. The first end of the tool defines a workpiece-deforming surface configured for making a predetermined press-brake deformation (e.g., a predetermined bend) in a workpiece when the workpiece-deforming surface is forced against the workpiece. The second end of the press brake tool has a tang mounted in a tool-mount channel defined by the tool holder. The tool-mount channel is bounded by two confronting walls of the tool holder, at least one of which is adapted to move selectively toward or away from the other in response to delivery of heat selectively to or from a thermally-responsive actuator of the tool holder. In the present embodiments, the tool holder has a load-delivering surface engaged with a load-receiving surface of the press brake tool.

In certain embodiments, the invention provides a method of operating a press brake tool holder. In these embodiments, the method comprises providing, in combination, the press brake tool holder and a press brake tool. The press brake tool has generally opposed first and second ends. The first end of the press brake tool defines a workpiece-deforming surface configured for making a predetermined press-brake deformation in a workpiece when the workpiece-deforming surface is forced against the workpiece. The second end of the press brake tool has a tang mounted in a tool-mount channel defined by the tool holder. The tool-mount channel is bounded by two confronting walls of the tool holder, wherein at least one of the confronting walls is adapted to move selectively toward or away from the other confronting wall in response to delivery of heat selectively to or from a thermally-responsive actuator of the tool holder. In the present embodiments, the method comprises delivering heat selectively to or from the thermally-responsive actuator of the tool holder so as to cause at least one of the confronting walls to move selectively toward or away from the other confronting wall.

In certain embodiments, the invention provides a press brake tool holder and a press brake tool in combination. In the present embodiments, the tool holder has a tool-mount channel in which a tang of the press brake tool is mounted. In these embodiments, the tool holder has a generally horizontal load-bearing surface engaged with a generally horizontal load-bearing surface of the press brake tool. The tool holder is adapted for forcing a tip of the press brake tool against a workpiece by delivering force from the generally horizontal load-bearing surface of the tool holder to the generally horizontal load-bearing surface of the press brake tool. The tool-mount channel is bounded by two confronting walls of the tool holder, wherein at least one of the confronting walls is adapted to move selectively toward or away from the other confronting wall in response to delivery of heat selectively to or from a thermally-responsive component of the actuator. In the present embodiments, the thermally-responsive component of the actuator comprises a thermally-expandable polymer and/or a shape-memory alloy. In certain embodiments of this nature, the tool holder is adapted for moving the press brake tool in a generally vertical direction.

In certain embodiments, the invention provides a method of operating a press brake tool holder. The method comprises providing, in combination, the press brake tool holder and a press brake tool. In the present embodiments, the tool holder has a tool-mount channel in which a tang of the press brake tool is mounted. Here, the tool holder has a load-bearing surface engaged with a load-bearing surface of the press brake tool. The tool-mount channel is bounded by two confronting walls of the tool holder, wherein at least one of the confronting walls is adapted to move selectively toward or away from the other confronting wall in response to delivery of heat selectively to or from a thermally-responsive component of the actuator. In the present embodiments, the thermally-responsive component of the actuator comprises a thermally-expandable polymer and/or a shape-memory alloy. The present method comprises forcing a tip of the press brake tool against a workpiece by delivering force from the load-bearing surface of the tool holder to the load-bearing surface of the press brake tool. In some cases, the tip of the press brake tool is forced against the workpiece by operating the tool holder so as to move the press brake tool in a direction generally normal to the load-bearing surface of the tool holder, such that the tip of the press brake tool is brought to bear forcibly against the workpiece. In certain of these cases, the load-bearing surface of the tool holder is generally horizontal, such that the tool holder moves the press brake tool in a generally vertical direction.

In certain embodiments, the invention provides a press brake tool holder having a thermally-responsive actuator. The tool holder has a tool-mount channel bounded by two confronting walls of the tool holder, wherein at least one of the confronting walls moves selectively toward or away from the other confronting wall in response to delivery of heat selectively to or from a thermally-responsive component of the actuator. In the present embodiments, the press brake tool holder has an internal chamber in which the thermally-responsive component of the actuator is disposed. In these embodiments, the thermally-responsive component comprises a thermally-expandable polymer and/or a shape-memory alloy.

DESCRIPTION OF PREFERRED EMBODIMENTS

The present invention involves a thermally-actuated press brake tool holder. The tool holder is actuated (i.e., opens or closes) in response to a heating or cooling step. Generally, the tool holder TH defines a channel C configured for receiving the tang of a press brake tool. This channel C is referred to herein as the tool-mount channel. The channel C is bounded by two confronting walls CW, CW' of the tool holder. As is perhaps best seen in FIGS. 1, 6-8, 11-14, and 17, the channel C in some embodiments is also bounded by a base wall BW. In the illustrated embodiments, the confronting walls CW, CW' are generally or substantially vertical (and preferably define surfaces that are generally or substantially vertical and planar), and the base wall BW is generally or substantially horizontal (and preferably defines a surface that is generally or substantially horizontal and planar). These features, however, are not required in all embodiments. Rather, the configuration of the wall(s) bounding the tool-mount channel C will vary depending upon the tool holder style in which the invention is embodied.

The tool holder will commonly be of the American, Wila, or European styles. However, the tool holder can take the form of various other press brake tool holder styles known in the art but currently in less widespread use. In fact, it will be appreciated that the tool holder TH can reflect any desired tooling style, including styles not yet developed, that would benefit from features of this invention. The tool holder, of course, can be a press brake beam, an adaptor mounted to a press brake beam, or any other type of press brake tool holder.

Certain embodiments of the invention involve a press brake tool. The tool can be a male forming punch or a female forming die. Typically, the tool TL has generally opposed first and second ends (or sides). Preferably, the first end (or side) of the tool defines a workpiece-deforming surface (e.g., at a tip) configured for making a predetermined press-brake deformation (e.g., a predetermined bend) in a workpiece when this workpiece-deforming surface is forced against the workpiece (e.g., when a tip of the tool is forced against a piece of sheet metal or the like). The second end (or side) of the press brake tool has a tang T that is configured for being mounted in the channel C of the tool holder TH, as will now be described.

Figure 2:
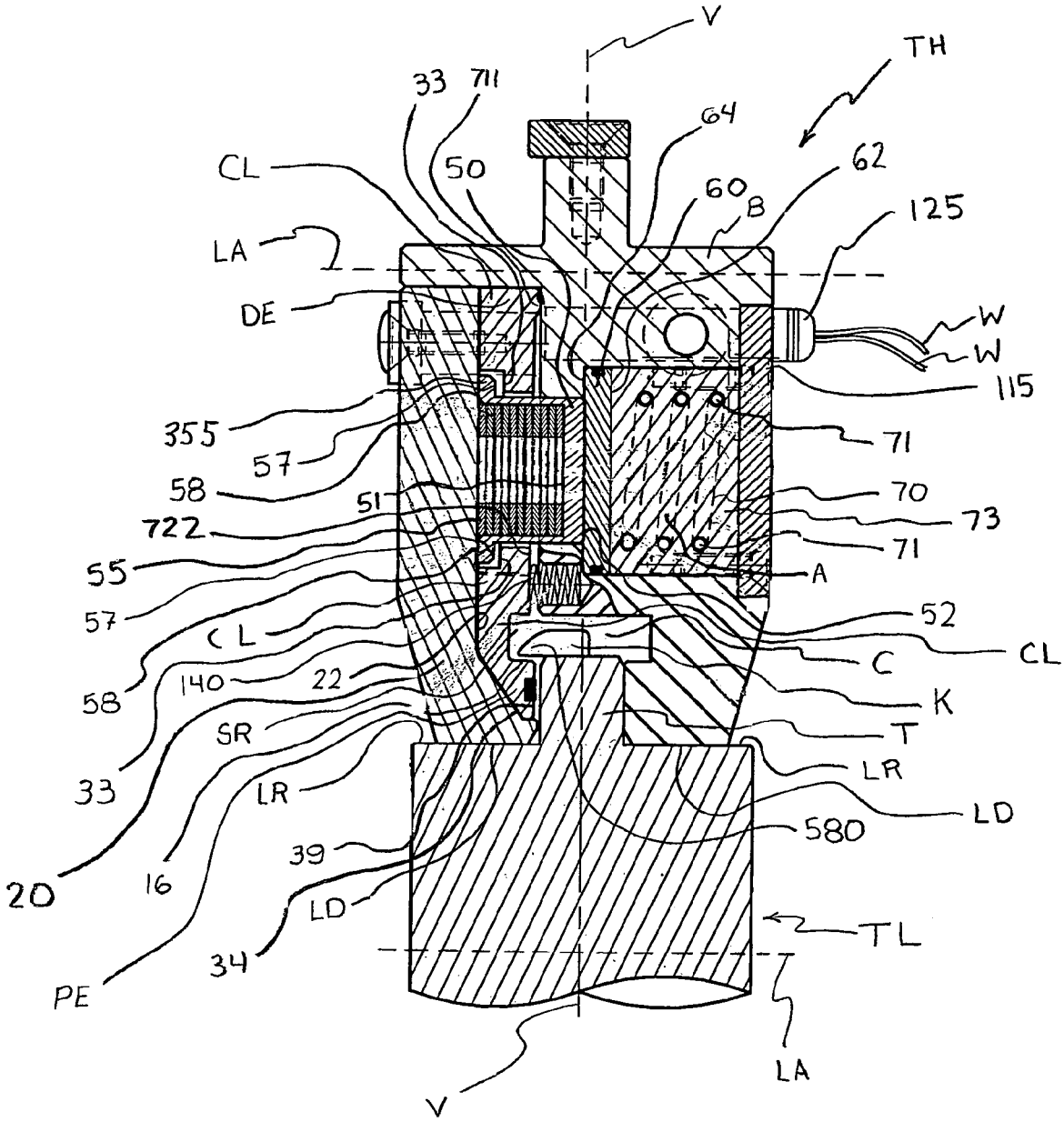
FIG. 2 is a schematic partially broken-away cross-sectional side view of a press brake tool holder and a press brake tool, in combination, in accordance with certain embodiments of the invention, the tool holder being depicted in an open configuration.
Figure 3:
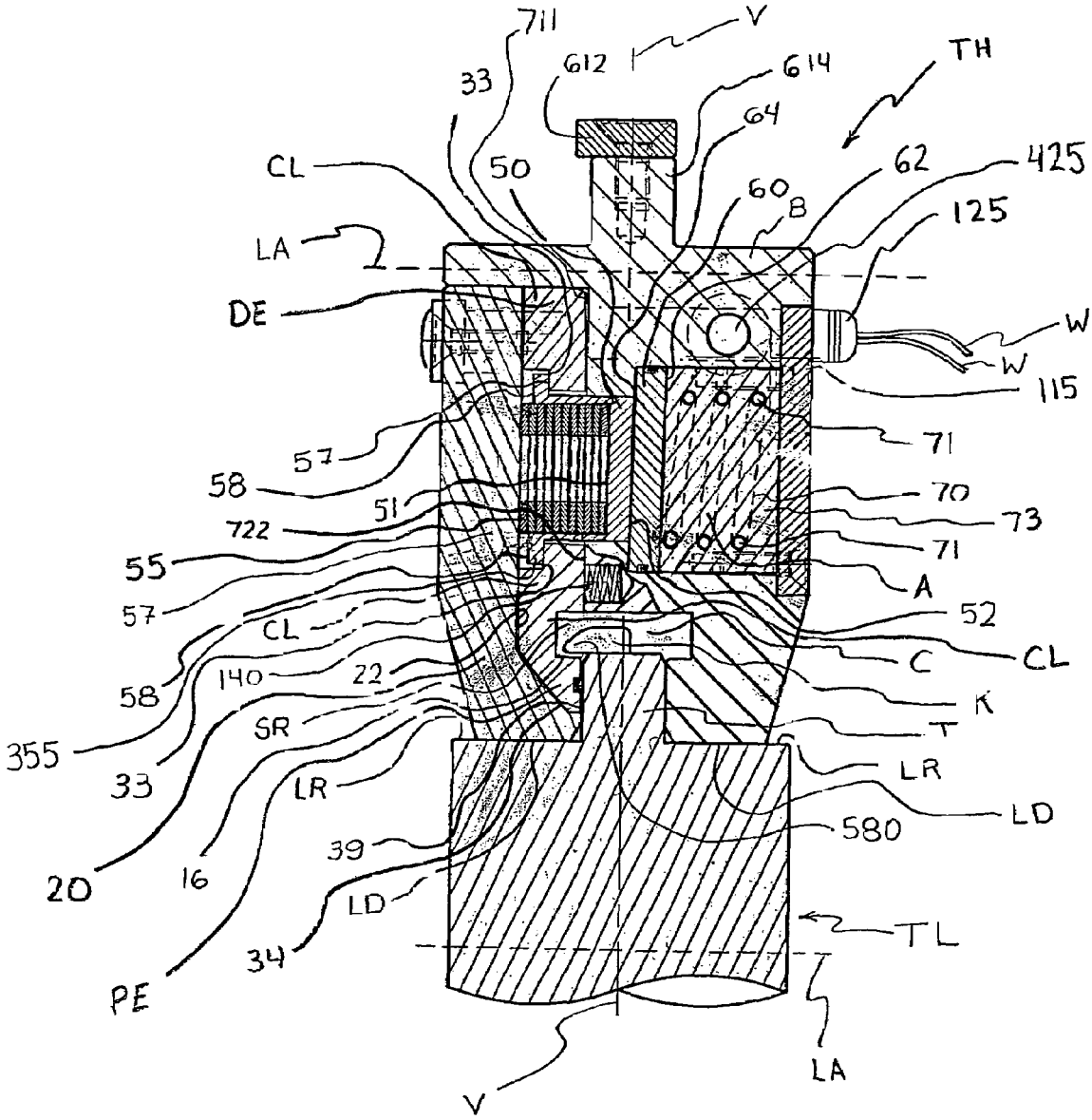
FIG. 3 is a schematic partially broken-away cross-sectional side view of the tool holder and tool combination of FIG. 2 wherein the tool holder is depicted in a closed configuration.

The tang T of the tool TL is sized and shaped to be received in the channel C of the tool holder TH (e.g., fitted snuggly in the channel so the tang is held rigidly in a stationary position relative to the tool holder). As noted above, the tang is typically at one end of the tool, while at least one workpiece-deforming surface is at another end of the tool. Referring to FIGS. 2-3, it can be appreciated that the tool TL has a vertical axis V (along which the height of the tool extends), and a lateral axis LA, along which the width of the tool TL extends. The tool also has a longitudinal axis, along which the length of the tool extends. The specific configuration of the tool, however, will vary with different embodiments. (The tool holder also has such a vertical axis V, lateral axis LA, and longitudinal axis LO).

In certain embodiments, the press brake tool TL has a safety key K. The safety key is not present in all embodiments of the invention. In some embodiments, though, the tool's tang T has a safety key K adapted for engaging a safety recess SR defined by the tool holder TH. The safety key can be retractable or non-retractable. Safety keys of both types are described in U.S. Pat. No. 6,467,327 (Runk et al.), and U.S. patent application Ser. No. 10/742,439, entitled "Press Brake Tooling Technology", the entire contents of each of which are incorporated herein by reference.

Figure 9:
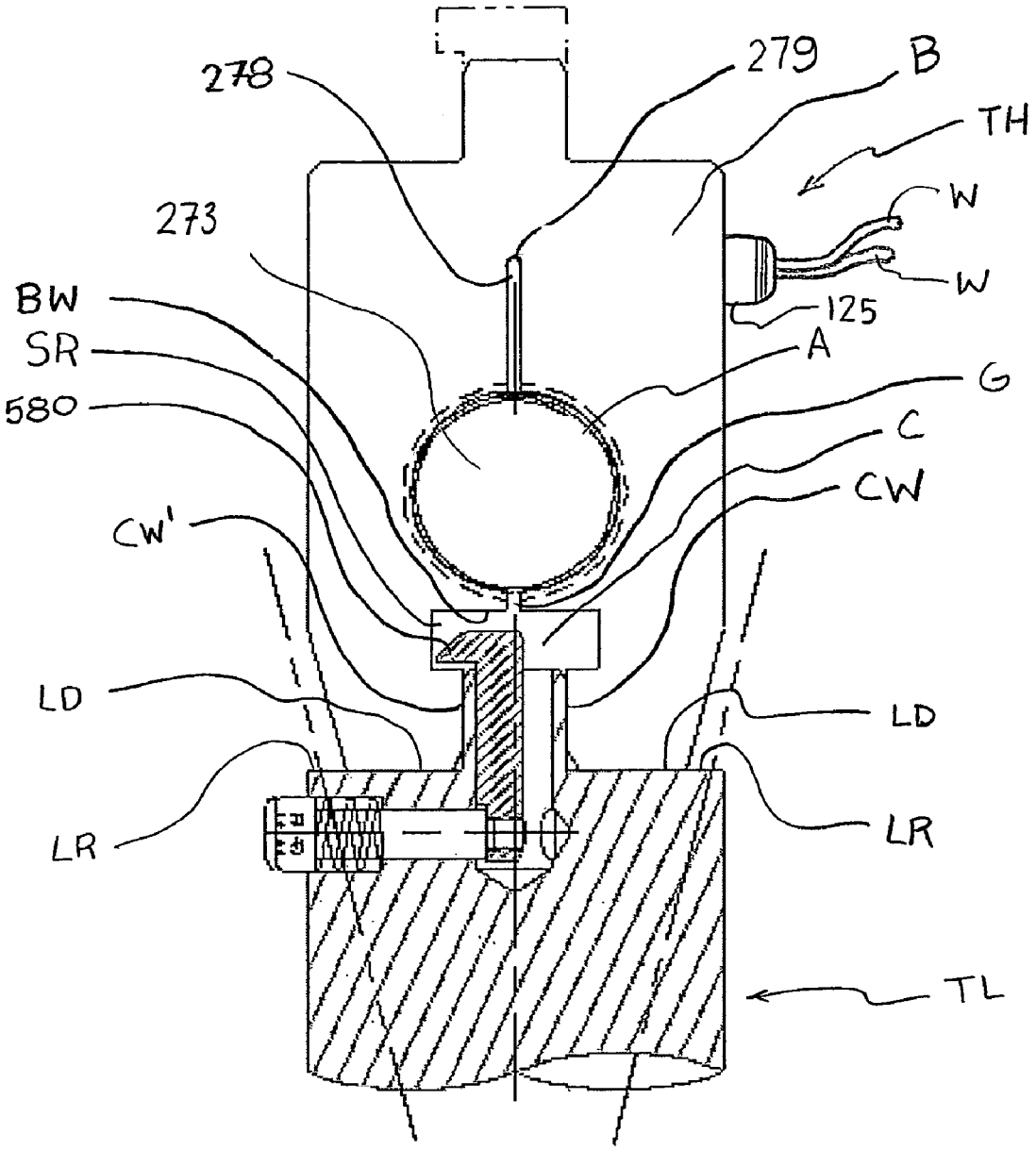
FIG. 9 is a schematic partially broken-away cross-sectional side view of a press brake tool holder and a press brake tool, in combination, in accordance with certain embodiments of the invention, the tool holder being depicted in a closed configuration.
Figure 10:
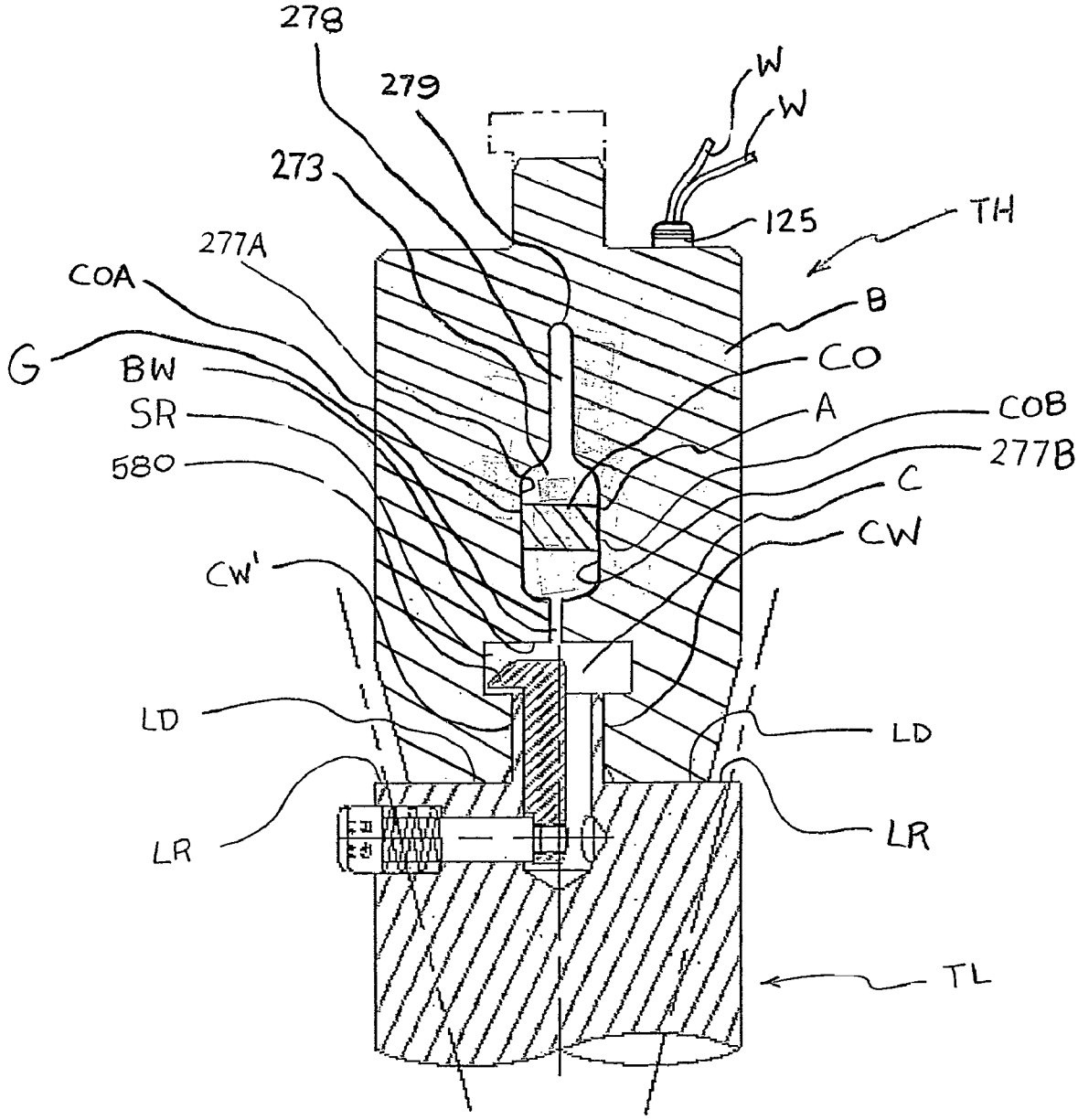
FIG. 10 is a schematic partially broken-away cross-sectional side view of a press brake tool holder and a press brake tool, in combination, in accordance with certain embodiments of the invention, the tool holder being depicted in a closed configuration.

In the case of a retractable safety key, the key is mounted on the tool so as to be moveable between an extended position and a retracted position. In more detail, the key preferably comprises a rigid engagement portion 580 that is moveable laterally relative to (e.g., generally toward and away from) the tool's tang. In some cases, the safety key is part of an assembly mounted inside and/or on the tool, and the assembly includes at least one spring resiliently biasing the safety key toward its extended position. Various assemblies of this nature can be used. One exemplary assembly is illustrated in FIGS. 9-10.

In the case of a non-retractable safety key, the key will typically comprise a rigid body projecting laterally from the tool's tang. When provided, the non-retractable safety key will generally either be integral to the tool's tang or rigidly joined to the tool's tang.

Thus, in some embodiments, the tool holder defines a safety recess SR. When provided, the safety recess SR desirably is sized to receive an engagement portion 580 of the safety key K. The optional safety recess SR desirably is at a location on the tool holder TH that is aligned with (e.g., horizontally) the safety key K of a press brake tool when such tool is operatively mounted in the channel C. In certain embodiments involving a tool holder in combination with a press brake tool, the tool has a safety key projecting away from the tang and engaged with (i.e., engaging, e.g., extending into) a safety recess defined by the tool holder, such that an engagement portion 580 of the safety key is received in the tool holder's safety recess. This is perhaps best appreciated in FIGS. 2-3 and 9-10.

Thus, some embodiments of the invention provide a press brake tool holder and a press brake tool in combination. As noted above, the tool TL has opposed first and second ends.

Preferably, the first end of the tool defines a workpiece-deforming surface configured for making a desired deformation (e.g., a desired bend) in a workpiece when this surface is forced against the workpiece. The second end of the tool desirably has a tang mounted in the channel C of the tool holder. As noted above, the channel C is typically bounded by two confronting walls CW, CW' of the tool holder. Preferably, at least one of these confronting walls can be displaced (e.g., moved) selectively toward or away from the other by operating a thermally-responsive actuator of the tool holder.

In certain embodiments, the tool holder TH has a load-delivering surface LD configured for engaging a load-receiving surface LR of a press brake tool TL. Preferably, the tool holder TH has a generally or substantially horizontal load-delivering surface LD that is adapted to engage and deliver force to a corresponding generally or substantially horizontal load-receiving surface LR of the tool TL. In certain embodiments (e.g., involving a tool mounted operatively in a tool holder), the tool holder has a load-delivering surface LD engaged with (e.g., carried directly against) a load-receiving surface LR of the tool TL (the surfaces LD, LR preferably are generally or substantially horizontal) In some embodiments, the tool holder TH has two horizontal load-delivering surfaces LD. For example, FIGS. 1-10 depict tool holders each having two horizontal load-delivering surfaces LD separated by the opening to channel C. These two surfaces LD are configured for engaging and delivering force to two corresponding load-receiving surfaces LR of a press brake tool TL. Thus, the surfaces LD, LR are load-bearing surfaces. In FIGS. 1-3 and 6-10, the two surfaces LD lie in the same horizontal plane.

In FIGS. 2-3 and 9-11, the two horizontal load-delivering surfaces LD of the illustrated tool holders are downwardly-facing surfaces and the two horizontal load-receiving surfaces LR of the illustrated tools are upwardly-facing surfaces. In other embodiments (e.g., where the tool holder is on the lower beam of a press brake), the horizontal load-delivering surface(s) LD of the tool holder is/are upwardly facing, and the horizontal load-receiving surface(s) of the tool is/are downwardly facing.

In some cases, the tool holder TH has only one horizontal load-delivering surface LD. This is the case, for example, in certain Wila-style embodiments wherein the top surface of the tool's tang is a horizontal load-receiving surface that is mounted directly against a horizontal base wall BW of the tool holder.

In some embodiments, when the tang T of a press brake tool is operatively mounted in the channel C of the tool holder TH, each load-delivering surface LD of the tool holder is generally or substantially horizontal and is carried directly against a corresponding generally or substantially horizontal load-receiving surface LR of the tool. This is perhaps best appreciated in FIGS. 2-3 and 9-10.

In certain embodiments, the tool holder TH is adapted for forcing the workpiece-deforming surface(s) of the press brake tool TL (when the tool is operatively mounted in the tool holder) against a workpiece by delivering force from the load-delivering surface(s) of the tool holder to the load-receiving surface(s) of the tool. Preferably, the tool holder is adapted for moving the operatively mounted press brake tool in a direction generally or substantially normal to the load-delivering surface(s) of the tool holder. In certain preferred embodiments, each load-delivering surface LD of the tool holder is generally or substantially horizontal, such that the tool holder is adapted for moving the press brake tool in a generally or substantially vertical direction (e.g., along axis V, as seen in FIGS. 2-3). Thus, in some cases, the tool holder is adapted for moving the operatively mounted tool vertically into and out of engagement with a workpiece (e.g., when the workpiece is secured in place between the upper and lower tables of the press brake)

The tool holder can be operably coupled to a press brake ram that is adapted for moving the tool holder and the mounted tool together so as to force the workpiece-deforming surface (e.g., a tip) of the tool against the workpiece. Here, the ram is preferably adapted for moving the tool holder TH in a direction generally or substantially normal to the load-delivering surface(s) LD of the tool holder.

In preferred embodiments, the tool holder TH has a closed configuration and an open configuration. When the tool holder is in its open configuration (shown in FIGS. 1-2, 6, and 8), the tang T of a press brake tool can be moved into and out of the tool holder's channel C. When the tool holder is in its closed configuration (shown in FIGS. 3, 7, and 9-11), the tang of a press brake tool in the tool holder's channel is clamped forcibly (e.g., and held rigidly) between the confronting walls of the tool holder.

Thus, the confronting walls CW, CW' of the tool holder are separated by a greater distance when the tool holder is in its open configuration than when it is in its closed configuration. In certain embodiments of this nature, the confronting walls CW, CW' are spaced further apart when in the open configuration, as compared to their separation when in the closed position, by at least about 0.005 inch, more preferably by at least about 0.010 inch, and perhaps optimally by at least about 0.015 inch. In some cases, the confronting walls are spaced further apart by between about 0.005 inch and about 0.5 inch, perhaps more preferably between about 0.010 and about 0.25 inch, and perhaps optimally between about 0.15 and about 0.10 inch.

The tool holder is provided with a thermally-responsive actuator A. Preferably, the tool holder opens or closes, selectively, in response to operation of the actuator. That is, operating the actuator A preferably causes the tool holder to open or close, selectively. The actuator is operated by heating or cooling (i.e., by delivering heat to or from) a thermally-responsive component of the actuator. Thus, in some cases, heating the thermally-responsive component of the actuator causes the tool holder to either open or close. In some such cases, heating causes the tool holder to move from its closed position to its open position, and cooling (which could include simply stopping or reducing heat delivery) causes the tool holder to move from its open position to its closed position. In other cases, heating causes the tool holder to move from its open position to its closed position, and cooling causes the tool holder to move from its closed position to its open position.

Thus, the tool holder can be moved selectively between its closed and open configurations by selectively performing a heating or cooling step on a thermally-responsive component of the actuator. In certain embodiments, the thermally-responsive component of the actuator comprises a thermally-expandable material. In many embodiments of this nature, the thermally-expandable material is a material that expands when it melts or is otherwise heated. In other embodiments, though, the thermally-expandable material is a material that expands when it freezes (e.g., water) or is otherwise cooled.

In certain preferred embodiments, the thermally-responsive component of the actuator A comprises a thermally-expandable material that undergoes a solid-liquid phase change in response to a very small temperature change. In some cases, the actuator A is adapted to move the tool holder from its closed configuration to its open configuration in response to a heat delivery step that causes the thermally-expandable material to undergo a solid-liquid phase change (i.e., a solid to liquid phase change or a liquid to solid phase change). Additionally or alternatively, the actuator A may be adapted to move the tool holder from its open configuration to its closed configuration in response to a heat delivery step that causes the thermally-expandable material to undergo a solid-liquid phase change.

In certain particularly preferred embodiments, the actuator A comprises a thermally-expandable polymer, as described below in further detail.

In certain embodiments, the thermally-responsive component of the actuator comprises a shape-memory material (e.g., a shape-memory alloy). Shape-memory materials are a special class of materials that have shape-memory characteristics when heated or cooled. These materials, after being deformed, recover their original shape when subjected to a heat-transfer step (i.e., a heating or cooling step). In some cases, the shape-memory material recovers its original shape when it is heated. In other cases, the shape-memory material recovers its original shape when it is cooled (which could include simply stopping or reducing heat delivery). Embodiments of both types can be provided by selecting an appropriate shape-memory material. In certain embodiments, there is provided a shape-memory alloy comprising Ti—Ni, Ti—Ni—Fe, Cu—Zn—Al, or Cu—Al—Ni. These alloys can include small amounts of other metals, preferably non-ferrous, if so desired (e.g., to improve shape-memory characteristics). In some embodiments, the alloy consists essentially of the noted metals. One type of shape-memory alloy that is particularly useful is a nickel-titanium alloy, such as that known commercially as Nitinol, which comprises about 55% nickel and about 45% titanium. Such an alloy exhibits hardness and strength comparable to steel, has excellent corrosion resistance, and has a high reversible deformation property. Nickel-titanium alloy has a transformation temperature that can be adjusted between the marstenstitic and austhentic microstructure in a range from −100 to 100 degrees C. by using an appropriate alloy composition.

FIG. 10 depicts one exemplary embodiment wherein the thermally-responsive component of the actuator comprises a shape-memory material. Here, the thermally-responsive component CO of the actuator comprises a body (e.g., a block) comprising (e.g., formed of) a shape-memory alloy. This body can have various configurations. Preferably, it is rectangular, cylindrical, or otherwise elongated in the lateral dimension, at least if the deformation property of this body is particularly great along the length of the body, as is relatively common with shape-memory alloys. Preferably, the shape-memory alloy is one that assumes its marstenstitic microstructure at room temperature, such that the body CO is relatively easily deformed when at room temperature. This allows the tool holder, which assumes its closed configuration when in an undeformed state, to remain in the closed configuration at all times other than when the thermally-responsive component CO is heated above its transformation temperature (which preferably is well above room temperature, and well above the temperatures that occur in the environment surrounding the tool holder during normal operating conditions). When sufficiently heated (e.g., above transformation temperature), the shape-memory alloy preferably assumes its austhentic microstructure, such that it recovers a shape having a greater lateral dimension than the shape it takes when the component CO is in its marstenstitic microstructure under the compressive load of the tool holder (i.e., the compressive load applied to the component CO by the walls 277A, 277B of the tool holder). When component CO is in its elongated shape, opposed sides COA, COB of the component CO bear forcibly against confronting inside surfaces 277A, 277B of the cavity (or "chamber") 273 in which the component CO is disposed. The force thus exerted by the thermally-responsive component, when in its marstenstitic microstructure, on the inside surfaces 277A, 277B of the tool holder is selected in conjunction with the material(s) and configuration of the tool holder such that this force deforms the tool holder (e.g., deforms a block or wall B of the tool holder itself) enough to allow the tang T of a press brake tool TL to be moved into or out of the tool holder's channel C. In some embodiments of this nature, the deformation moves the confronting walls CW, CW' further apart (i.e., moving from the closed configuration to the open configuration) by at least about 0.005 inch, more preferably by at least about 0.010 inch, and perhaps optimally by at least about 0.015 inch. In one embodiment, the deformation moves the confronting walls further apart by between about 0.010 inch and about 0.1 inch.

Thus, in certain embodiments, the tool holder comprises a shape-memory alloy component CO disposed between two confronting surfaces 277A, 277B of the tool holder. The shape-memory alloy component when subjected to a desired heat-transfer step (e.g., when heated or cooled) expands in at least one dimension (e.g., upon assuming a particular microstructure) so as to apply force to the confronting surfaces 277A, 277B of the tool holder. In these embodiments, the force so delivered causes the tool holder to move either from its open position to its closed position or from its closed position to its open position. In the embodiment shown in FIG. 10, the tool holder comprises a block B that defines the confronting surfaces 277A, 277B as well as the confronting walls CW, CW', such that when the shape-memory component CO is expanded in the manner described, the force delivered to the confronting surfaces 277A, 277B causes the block B itself to deform such that the confronting walls CW, CW' of the block B move apart (i.e., away from each other). The block B defining both the confronting surfaces 277A, 277B and the confronting walls CW, CW' can optionally be a single (i.e., one piece/unitary/integral) metal block (e.g., of steel).

FIG. 10 is representative of a group of embodiments wherein the tool holder comprises a wall or block B having an internal cavity (or "chamber") 273 in which a thermally-responsive component (e.g., comprising a polymer or an alloy) CO is disposed, and where performing a desired heat-delivery step upon the thermally-responsive component causes the component to expand so as to deliver force to generally-opposed surfaces 277A, 277B bounding the cavity 273 such that the wall or block B itself deforms in such a way that the confronting walls CW, CW' of the tool holder (which preferably are both defined by the wall or block B) move further apart. FIG. 9 is also representative of such embodiments. In some of the present embodiments, the deformation of the wall or block B causes the confronting walls CW, CW' to move further apart by a distance within one or more of the ranges described in the preceding paragraph. Further, in some of the present embodiments, the cavity 273 is open to (e.g., communicates with) a vertically-elongated channel 278 that has a more narrow lateral width than the cavity region 273 in which the thermally-responsive component CO is disposed. The optional channel 278 desirably terminates at a radiused end 279. Further, a gap G can optionally extend between (entirely between, substantially between, partially between, etc.) the tool mount channel C and the cavity 273 in which the thermally-responsive component CO is disposed.

In certain embodiments, the thermally-responsive component of the actuator A comprises a thermally-expandable material that expands or contracts upon being heated or cooled (e.g., respectively). In some cases, paraffin or wax is used (e.g., a sharp melting point wax). Preferably, the thermally-expandable material undergoes a solid-liquid phase change when subjected to a desired heat-transfer step. In certain embodiments, the thermally-expandable material is a thermally-expandable polymer. A medium chain polyethylene is used in some cases.

Figure 6:
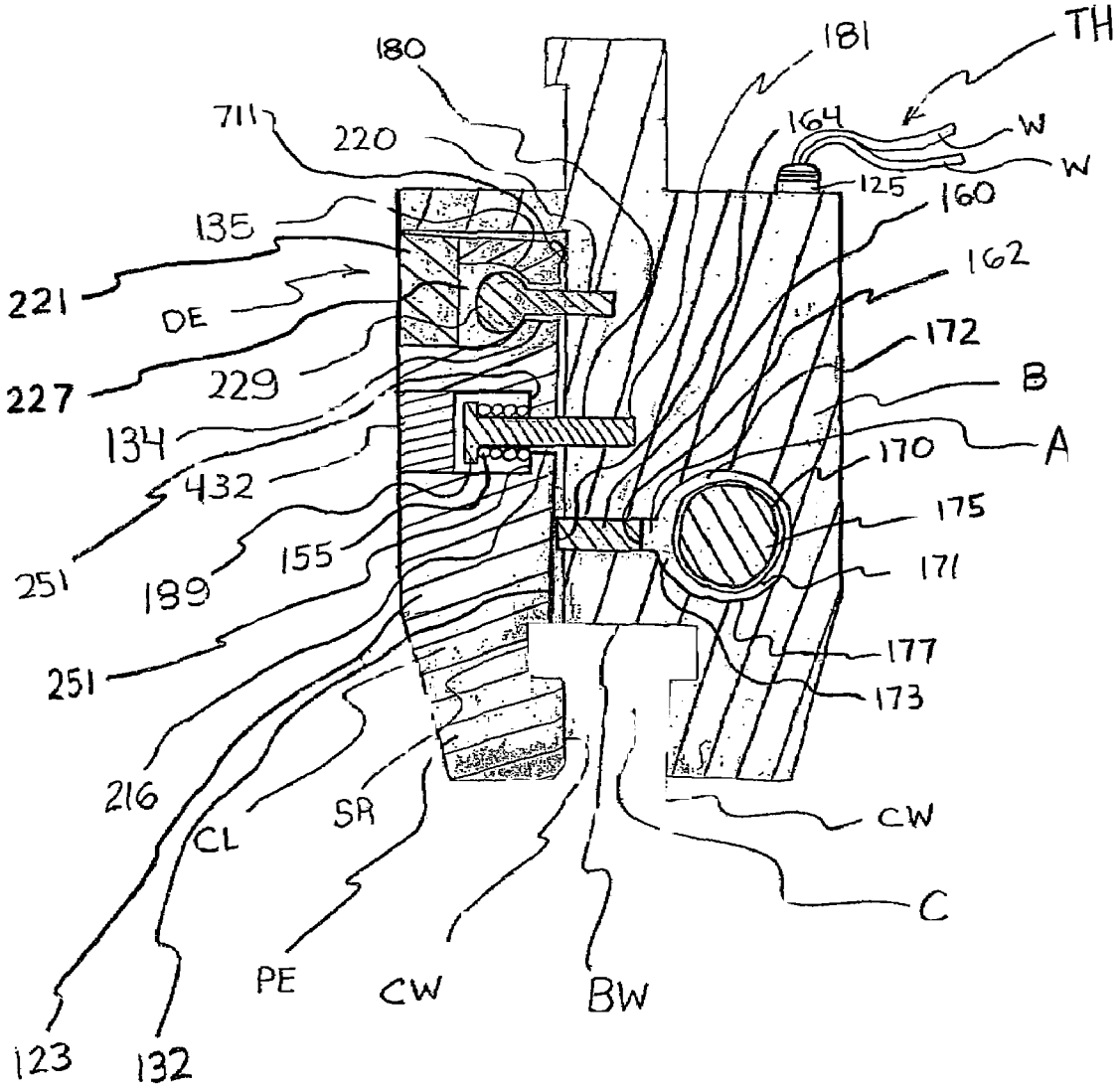
FIG. 6 is a schematic cross-sectional side view of a press brake tool holder in accordance with certain embodiments of the invention, the tool holder being depicted in an open configuration.
Figure 7:
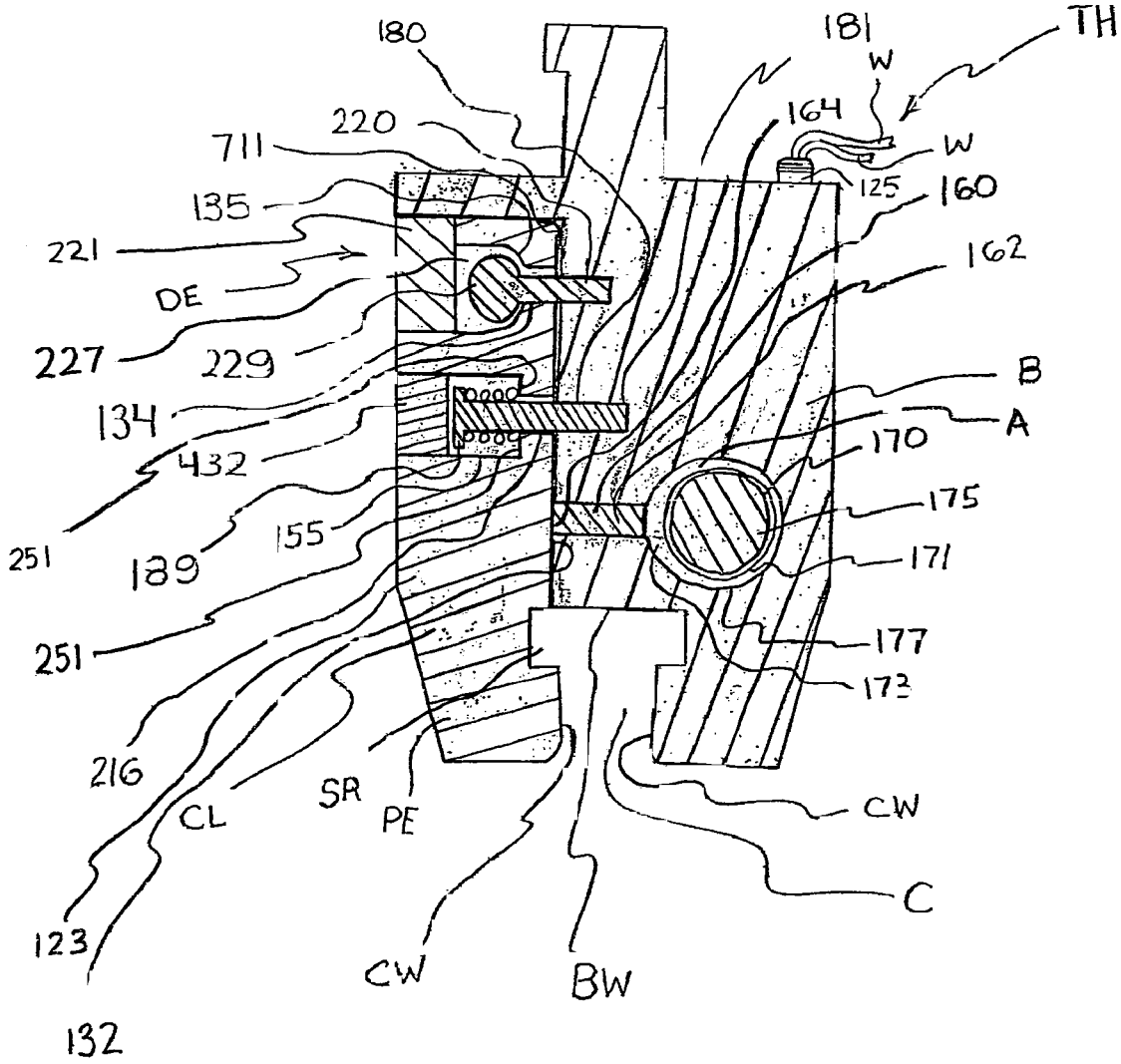
FIG. 7 is a schematic cross-sectional side view of the tool holder of FIG. 6 wherein the tool holder is depicted in a closed configuration.
Figure 8:
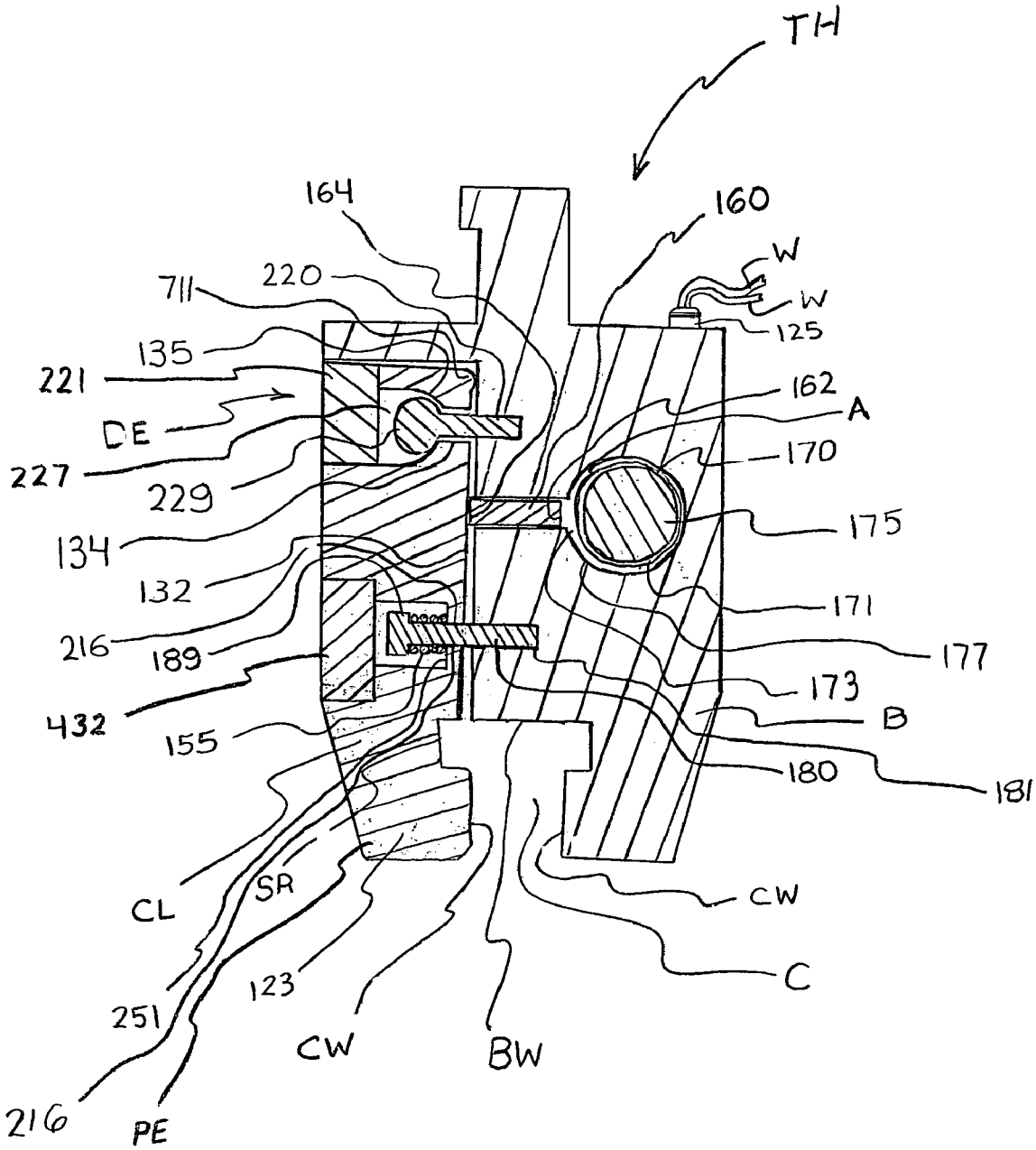
FIG. 8 is a schematic cross-sectional side view of a press brake tool holder in accordance with certain embodiments of the invention, the tool holder being depicted in an open configuration.

In some embodiments, the actuator A comprises thermally-expandable material disposed in a reservoir (or "chamber") of the tool holder. FIGS. 6-8 depict one particular reservoir 173. Here, the tool holder has a wall or block B defining an internal surface 177 that bounds the reservoir 173. The reservoir 173 in FIGS. 6-8 is generally annular in cross section, although this is by no means required. In more detail, this reservoir 173 comprises a longitudinally elongated (e.g., cylindrical) bore in which a longitudinally elongated (e.g., cylindrical) body 175 is disposed so as to form an annular recess between the tool holder's internal surface 177 and the body 175. The gap between the body 175 and the tool holder's internal surface 177 can be enlarged adjacent the outlet 172 region of the reservoir 173, if so desired (e.g., by positioning body 175 eccentrically within the reservoir). This may provide good flow characteristics adjacent the outlet 172 region of the reservoir 173. It may also be desirable to provide grooves on the side of the body 175 to provide good flow characteristics, and/or to leave gaps between the coils 171 in the areas of peak flow, as described in U.S. Pat. No. 6,522,953, the entire contents of which are incorporated herein by reference.

It can thus be appreciated that certain embodiments involve a reservoir from which there extends at least one channel (e.g., in which a moveable body may be slidably disposed). In some embodiments of this nature, thermally-expandable material flows through or is otherwise in this channel (e.g., or at least part of the channel), at least at certain times. In one embodiment of this nature, the channel is provided with a heat-transfer element (e.g., at least part of a heating element extend into the channel and/or a wall bounding at least part of the channel may comprise a heating element). This may be useful to keep liquid phase material in the channel in a flowable form. In FIGS. 6-8, the outlet 172 is one example of such a channel.

With continued reference to FIGS. 6-8, the cylindrical body 175 and the tool holder wall B will commonly be formed of metal (e.g., steel). In some cases, these elements 175, B are formed of material that dissipates heat quickly (e.g., aluminum). While an annular reservoir is advantageous in terms of dissipating heat from material in the reservoir, various reservoir configurations (e.g., cubic, conical, or irregularly-configured reservoirs) can be used.

The thermally-responsive actuator A preferably comprises at least one heat-transfer element (e.g., at least one heating element). The heat-transfer element desirably is adapted to deliver heat to and/or from a thermally-responsive component of the actuator. The heat-transfer element can be provided in various forms. For example, it can comprise conduits (e.g., tubes) for circulating hot and/or cold water or other fluids adjacent (e.g., in thermal contact with) the thermally-responsive component of the actuator. In some cases, disposed in the reservoir is a helical tubing (e.g., of brass or copper alloy) adapted for circulating hot and/or cold fluid. Useful heat-transfer conduits are described in U.S. Pat. No. 6,481,204, the entire contents of which are incorporated herein by reference. Thus, in certain embodiments, the tool holder has a reservoir or "chamber" in which there is disposed both a thermally-expandable material (e.g., polymer) and a heat-transfer element (e.g., a heating element disposed at least in part within the reservoir).

In certain embodiments, the tool holder is provided with an electric heating element positioned adjacent (e.g., in thermal contact with) the thermally-responsive component of the actuator. Upon applying current to the electrodes of such a heating element, the heating element increases in temperature and delivers heat to the thermally-responsive component of the actuator, thereby causing the thermally-responsive component of the actuator to expand and/or assume a desired shape. Once the current through the electrodes is terminated, the heat in the heating element dissipates and the thermally-responsive component returns to its original size and/or its original shape. Generally, the heating of the actuator's thermally-responsive component can be accomplished by one or more of electrical resistance heating, fluid exchange heating, chemical reaction heating, convection heating, and radiation heating.

Figure 1:
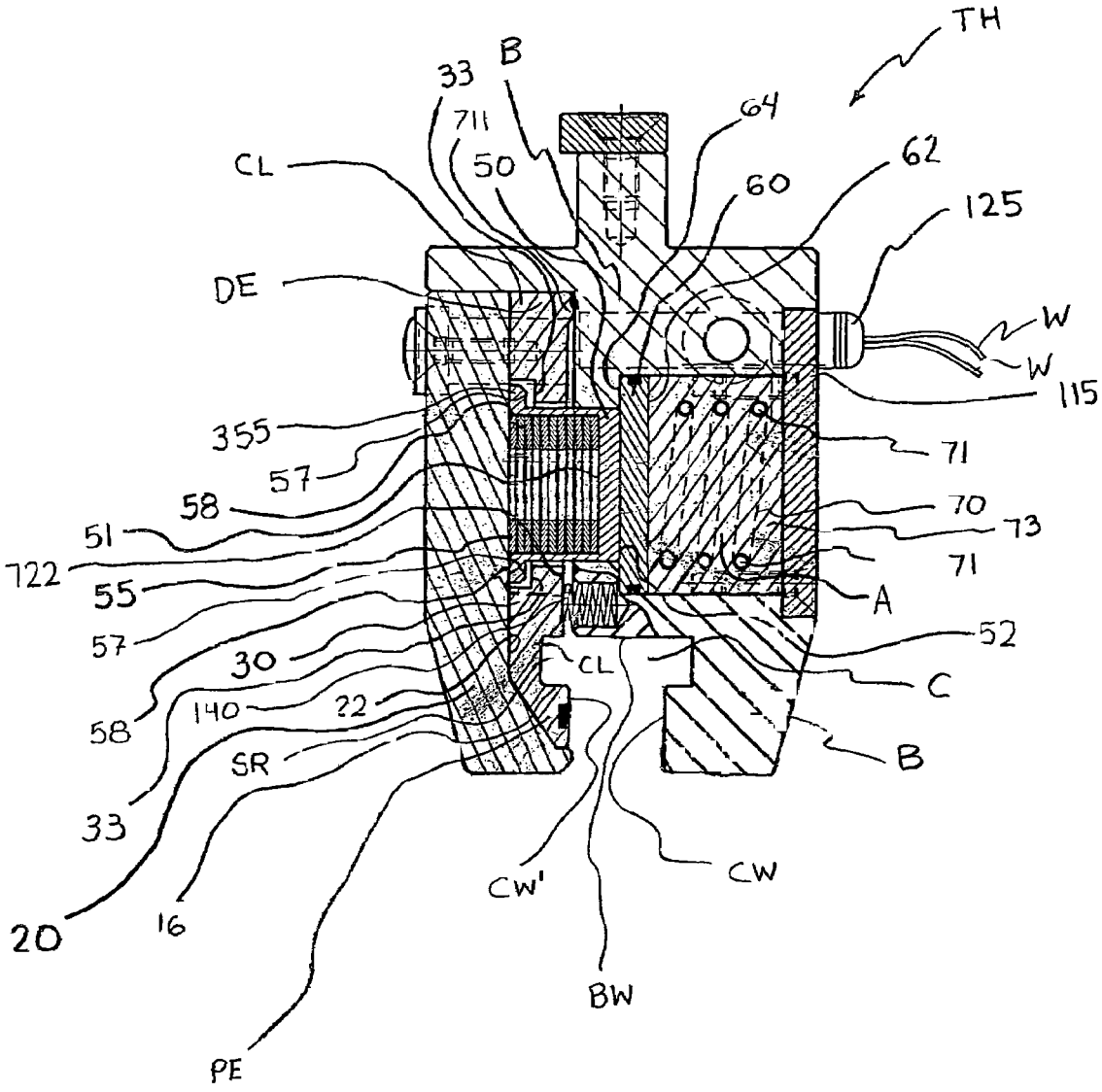
FIG. 1 is a schematic cross-sectional side view of a press brake tool holder in accordance with certain embodiments of the present invention, the tool holder being depicted in an open configuration.

Referring to FIGS. 1-3, the heat-transfer element 70 can advantageously comprise one or more heat-transfer coils 71. In FIGS. 1-3, heat-transfer coils 71 (e.g., wires or conduits) are positioned in the reservoir 73 so as to be in thermal contact (and optionally in physical contact with) with thermally-expandable material in the reservoir 73. The coils can advantageously be provided in the form of nichrome heating wires, optionally mounted on electrically-insulating members (e.g., of plastic). When a thermally-expandable polymer is used in the reservoir, it may be desirable to space such wires within a few polymer molecule lengths (e.g., less than about 0.3 cm, and perhaps optimally less than about 0.1 cm) away from one another and/or from the interior surface of the reservoir. In FIGS. 6-8, the heat-transfer element 170 also comprises heat-transfer coils 171 in thermal contact with thermally-expandable material in the reservoir 173. Here, the body 175 supports the coils (which can be helical or annular conduits or wires) in a position spaced between body 175 and interior surface 177. It is to be appreciated that a wide variety of heat-transfer elements can be used in place of those shown in the drawings.

Figure 11:
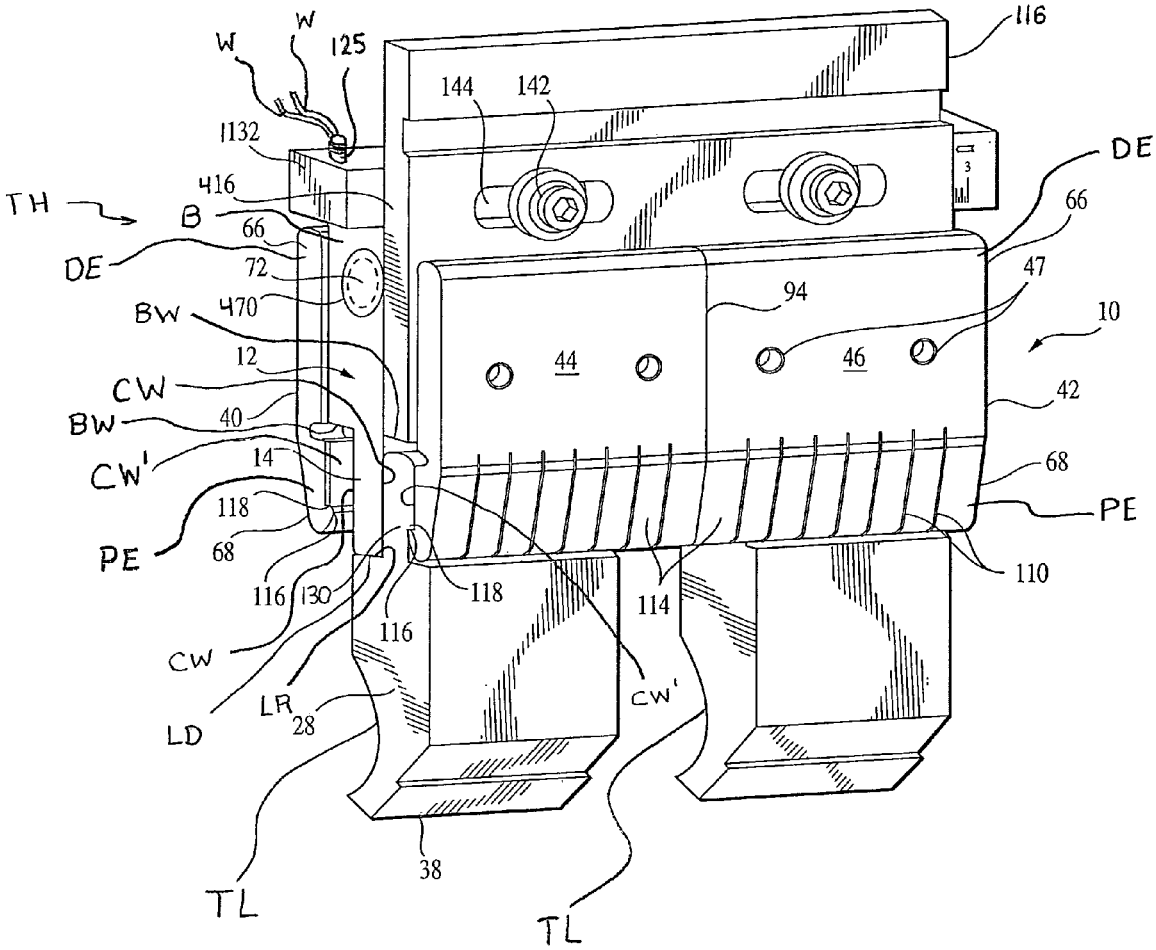
FIG. 11 is a schematic perspective view of a press brake tool holder and a press brake tool, in combination, in accordance with certain embodiments of the invention, the tool holder being depicted in a closed configuration.

In certain embodiments, at least one of the confronting walls CW, CW' of the tool holder TH is defined by a clamp CL. The optional clamp is adapted to move (e.g., is mounted on the tool holder for movement) between an open position and a closed position. FIGS. 1-2, 6, and 8 illustrate various embodiments in which a clamp CL is depicted in the open position. FIGS. 3, 7, and 11 illustrate various embodiments in which a clamp CL is depicted in the closed position. Preferably, the clamp is adapted to move selectively into either the open position or the closed position in response to selective heating or cooling of a thermally-responsive component of the tool holder's actuator. For example, the thermally-responsive component of the actuator can comprise a thermally-expandable material (e.g., a thermally-expandable polymer, optionally in a reservoir of the tool holder), and the clamp can be operably coupled to a movable body in communication (e.g., fluid communication) with the thermally-expandable material, such that when the thermally-expandable material is heated or cooled so as to expand or contract, resulting movement of the moveable body causes the clamp CL to move toward (and preferably into) either the open position or the closed position. In some cases, resulting movement of the moveable body forces the moveable body directly against (e.g., into direct, forcing contact with) the clamp. In other cases, resulting movement of the moveable body forces it against another moveable body that is thereby forced against the clamp. Many other variations can also be used.

In embodiments wherein the tool holder has a clamp CL, the clamp can optionally be mounted on a wall of the tool holder such that the clamp is moveable pivotally (about a desired pivot point) between its open and closed positions. Thus, when the clamp is made to pivot in one direction (either clockwise or counterclockwise), one end PE of the clamp (the tool-engagement end) moves toward the tool holder's channel, whereas when the clamp is made to pivot in the opposite direction, the tool-engagement end PE of the clamp moves away from the channel C (e.g., away from a tool tang mounted in the channel).

In certain embodiments, the tool holder includes a clamp CL mounted to a wall or block B of the tool holder such that the clamp has a limited range of freedom to move pivotally about a pivot point at the distal end DE of the clamp. Here, the distal end DE (or distal end region) of the clamp CL defines the pivot point. In some embodiments of this nature, the clamp is under (i.e., receives) a constant force biasing the clamp toward its closed position (i.e., a clamp-closing force). This is perhaps best appreciated with reference to FIGS. 1-3 and 6-8, wherein at least one primary spring member 55, 155 biases (i.e., urges) the clamp toward its closed position. Several useful spring assemblies are described below in further detail.

In certain preferred embodiments, the tool holder provides a positive lock. That is, the tool holder is locked in a closed configuration at all times, unless heat is affirmatively delivered to or from the thermally-responsive actuator (i.e., enough heat to cause actuation). In these embodiments, the default configuration of the tool holder is its closed configuration. Thus, if there is a power failure or other event that interrupts operation, the tool holder will remain locked. This would prevent a tool mounted in a tool holder on the upper beam of a press brake from inadvertently falling in the event of a power failure or the like.

Figure 17:
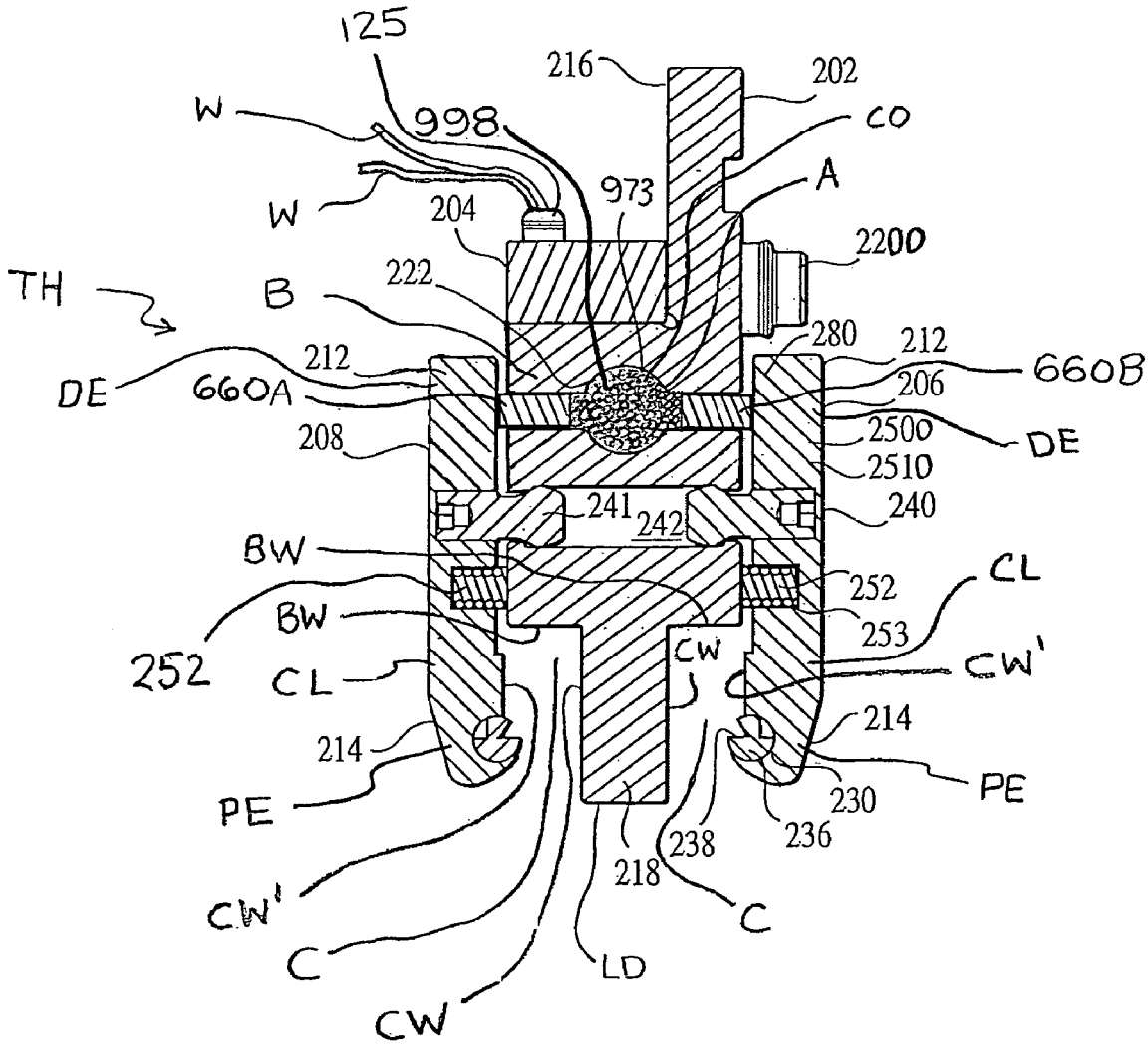
FIG. 17 is a schematic cross-sectional detail side view of a press brake tool holder in accordance with certain embodiments of the invention.

One positive locking embodiment involves a thermally-responsive actuator comprising a thermally-expandable material that assumes a liquid phase at room temperature (or "ambient temperature"). Here, the tool holder can be configured such that it is closed when the thermally-expandable material is in a liquid phase. In such a design, the thermally-expandable material would be cooled to cause a release (opening) of the clamp. In certain embodiments, the material has a melting/freezing point of about 10 degrees Celsius. FIG. 17 depicts one exemplary embodiment that can be configured and used in this manner. Here, the tool holder TH has a reservoir 973 in which thermally-expandable material 998 is contained. The thermally-expandable material can be selected such that it remains in a liquid phase at room temperature. When in the liquid phase, the thermally-expandable material 998 bears forcibly upon moveable bodies 660A, 660B, which are thereby made to bear forcibly upon two clamps CL, respectively, thus keeping the clamps in their closed position. When it is desired to open the clamps, a cooling step is performed upon the material 998 in the reservoir 973, causing this material 998 to contract. This removes or sufficiently reduces the clamp-closing force, such that at least one secondary spring member 252 bearing upon each clamp CL moves such clamp to an open position.

It can thus be appreciated that in certain embodiments a clamp CL is mounted on a wall or block B of the tool holder such that the clamp is moveable pivotally about a desired pivot point. The clamp in some such embodiments is adapted to receive (e.g., is linked to one or more thermally-responsive actuators adapted for delivering to the clamp) a clamp-opening force. The clamp-opening force is received at a first location (a first force-delivery point) on the clamp. In some cases, the clamp is under a constant clamp-closing force, which is received at a second location (a second force-delivery point) on the clamp. In some cases, the first and second force-delivery points are at different locations (e.g., different vertical locations) on the clamp. For example, the first location in certain embodiments is further from the clamp's pivot point than is the second location, such that the clamp-opening force has mechanical advantage over the clamp-closing force. In some embodiments of this nature, a spring delivers the clamp-closing force to a location on the clamp (i.e., the "second location") that is closer to the pivot point than is the location on the clamp where a clamp-opening force is delivered to the clamp (i.e., the "first location") when a thermally-responsive actuator of the tool holder is actuated. This mechanical advantage situation can be desirable in that the opening force from the actuator has a greater lever arm than does the closing force from the spring. This is perhaps best appreciated with reference to FIGS. 6-7. While embodiments of this nature are advantageous, the invention is by no means limited to such arrangements. For example, FIG. 8 shows an alternate embodiment wherein the force of the spring 155 has mechanical advantage over the force of the actuator 170.

With reference to FIG. 17, it can be appreciated that a spring 252 applies a constant clamp-opening force to the clamp CL and that the thermally-responsive actuator A is adapted for delivering a clamp-closing force to the clamp CL. This is representative of a class of embodiments wherein the thermally-responsive actuator (whether it is adapted to deliver a clamp-closing force or a clamp-opening force) has mechanical advantage over one or more springs biasing (or "urging") the clamp in a direction opposite the direction of the force the actuator is adapted to deliver to the clamp.

Several embodiments provide a clamp that is operably coupled to a thermally-responsive actuator so that when heat is delivered to thermally-expandable material in a reservoir of the actuator, this material expands and generates a force that causes the clamp to move into its open position. In these embodiments, the clamp stays open as long as heat delivery is maintained. When it is desired to close the clamp, heat delivery is stopped and/or the material in the reservoir is otherwise cooled. This causes the thermally-expandable material to cool and contract, removing the clamp-opening force. Generally, the clamp in such embodiments is under a constant closing force (i.e., a force biasing the clamp toward its closed position). Thus, when the clamp-opening force is removed, the constant closing force on the clamp moves the clamp into its closed position. Various clamp-closing mechanisms can be used.

One suitable clamp-closing mechanism involves one or more springs acting on the clamp so as to urge the clamp toward its closed position. Each such spring can be mounted on the tool holder in a compressed state such that the spring bears forcibly against a surface of the clamp, thus biasing the clamp toward its closed position. Several embodiments of this nature are described and illustrated in the present disclosure.

FIGS. 1-5 exemplify certain embodiments wherein the tool holder TH has a particularly advantageous clamp-closing mechanism. Here, the clamp-closing mechanism includes at least one primary spring member 55. This spring member 55 is mounted between (e.g., in a compressed state) a wall 20 of the tool holder and at least one moveable body. In FIGS. 1-5, two moveable bodies 50, 60 are provided (e.g., such that primary spring member is mounted between the tool holders' outer wall 20 on one side and the two moveable bodies 50, 60 on another other side). In more detail, the primary spring member 55 biases moveable body 50 toward moveable body 60. This tends to keep the moveable bodies 50, 60 in the position shown in FIG. 3, which depicts the tool holder in its closed configuration. In particular, spring member 55 bears forcibly against surface 51 of moveable body 50. This causes surface 52 of moveable body 50 to bear forcibly against surface 64 of moveable body 60. Thus, unless the thermally-responsive material in the reservoir 73 is in an expanded state (e.g., is in a liquid phase), the bias of spring member 55 causes the moveable bodies 50, 60 to move toward the reservoir 73. This causes surface 57 of moveable body 50 to bear forcibly against surface 33 of the clamp CL, urging it CL toward its closed position.

Tool holder embodiments like those shown in FIGS. 1-5 can be used in different ways. For example, the reservoir 73 of the tool holder TH can be filled with a thermally-responsive material that is a liquid at room temperature, such that the clamp CL is kept in an open position unless a cooling step is performed upon the material in the reservoir. Perhaps more preferably, the reservoir is filled with material that expands, and preferably transitions from a solid to a liquid, when it is heated to a desired elevated temperature (which desirably is well above room temperature). In such embodiments, the primary spring member 55, acting together with the moveable bodies 50, 60, would tend to keep the clamp CL closed unless a heat-delivery step were being performed upon the material in the reservoir. Sufficient heat delivery would cause the material in the reservoir to expand, thus bearing forcibly against surface 62 of moveable body 60. This would cause surface 64 of moveable body 60 to bear forcibly against surface 52 of moveable body 50, which in turn would cause surface 51 of moveable body 50 to bear forcibly against the primary spring member 55, compressing it 55 against outer wall 20 of the tool holder. This would result in flange 355 of moveable body 50 butting-up against outer wall 30 of the tool holder (as shown in FIGS. 1-2). This would also result in the clamp CL being moved to its open position, as it allows secondary spring member 140 to push the clamp open. When it is desired to close the clamp, heat delivery to the actuator A is stopped and/or a cooling step is performed upon the thermally-responsive material in the reservoir, thus causing the clamp to move back into its closed position.

FIGS. 6-8 also depict embodiments wherein at least one spring member 155 is used as a clamp-closing mechanism. Here, there is provided a post (e.g., a bolt) having a base end anchored in a wall or block of the tool holder. The post 180 has a central span between its anchored end 181 and its distal end 189. The distal end 189 of the post 180 preferably is formed by an enlarged/oversized head. Thus, the head of the post desirably has a diameter (or a desired vertical dimension and/or a desired longitudinal dimension) that is greater than that of the post's central span. In the embodiments of FIGS. 6-8, the central span of the post 180 extends through an opening 216 in the clamp. This opening is small enough to (and/or is shaped to) prevent the post's head from passing through this opening. A spring 155 is mounted in a compressed state between the head of the post 180 and surface 251 of the clamp, such that the compressed spring 155 bears forcibly upon surface 251 of the clamp CL and thereby biases the clamp toward its closed position. Thus, the spring 155 keeps the clamp in its closed position unless the actuator A is operated to bring about opening of the clamp, as described below.

Thus, in several embodiments of the invention, at least one of the confronting walls of the tool holder is defined by a clamp, and the clamp is operably coupled to a movable body that is in communication (e.g., fluid communication) with thermally-expandable material in a reservoir of the tool holder. In these embodiments, when the thermally-expandable material is heated or cooled so as to expand or contract, resulting movement of the movable body causes the clamp to move to an open position or a closed position. This is perhaps best understood with reference to FIGS. 1-3, 6-8, and 11-17. Preferably, the moveable body is in communication with the thermally-expandable material in the reservoir, such that when this material expands (e.g., transitions from a solid phase to a liquid phase), the moveable body is forced toward the clamp CL, such that this body either applies a clamp-opening force directly to the clamp or indirectly via one or more other moveable bodies. In certain embodiments, the tool holder is configured such that when the thermally-expandable material in the reservoir is heated enough to reach or exceed a predetermined design temperature, the force delivered from the expanding material to the moveable body is transferred by the moveable body to the clamp such that the clamp is urged toward its open position, this opening force being greater than, and overcoming, a constant clamp-closing force on the clamp (e.g., generated by one or more spring members of the tool holder), such that the clamp moves into its open position. In certain embodiments, the design temperature is a melting/freezing point, which preferably is at least about 42 degrees Celsius, perhaps more preferably at least about 44 degrees Celsius, and perhaps optimally at least about 46 degrees Celsius. A design temperature within any one or more of these ranges can be selected for any embodiment described in the present disclosure, if so desired.

Thus, it can be appreciated that the invention provides a class of embodiments wherein the tool holder comprises thermally-expandable material contained in a reservoir defined by rigid stationary walls of the tool holder together with at least one wall of a moveable body, such that the only moveable wall portion bounding the reservoir is defined by the moveable body. Embodiments of this nature are particularly useful.

In FIGS. 1-3, the tool holder includes a movable body 60 that preferably is a plate (or "platen"). This body 60, however, can take various different forms (e.g., it can be a block of various shapes). The body 60 has a surface 62 against which the thermally-expandable material bears forcibly when it is expanded (e.g., when it is in a liquid phase). Here, the thermally-expandable material bears directly against the moveable body, although this is not required. The resulting force on body 60 causes this body 60 to bear forcibly against a second movable body 50. The force delivered from the first movable body 60 to the second movable body 50 (which results when surface 64 of the first body 60 bears forcibly against surface 52 of the second body 50), causes the second body 50 to bear forcibly against the clamp CL. In FIGS. 1-3, it is surface 58 of body 50 that bears against surface 22 of the clamp in this manner, thus exerting an opening force on the clamp.

The tool holder shown in FIGS. 1-3 has a particularly advantageous construction. This construction reflects a class of embodiments wherein the tool holder includes a clamp that is mounted between two walls of the tool holder. Here, a clamp CL is disposed (e.g., mounted) between an outer wall 20 of the tool holder and an inner wall B of the tool holder. Preferably, the inner B and outer 20 walls are stationary (e.g., rigidly mounted in fixed positions). Generally, the clamp CL defines one of the confronting walls CW, CW' of the tool holder and is moveable between an open position and a closed position. Preferably, the clamp is moveable pivotally between its open and closed positions. The clamp illustrated in FIGS. 1-3 is adapted to pivot about one end DE of the clamp (e.g., about a radiused male projection 711 of the clamp at distal end DE), although this is by no means required. The clamp-opening force generated by the actuator A is delivered by movable body 50 to the clamp CL, as described above. When the clamp is forced open in this manner, the secondary spring 140 mounted (e.g., in a compressed state) between the clamp and the inner wall B of the tool holder bears against the clamp (e.g., against surface 722) and forces it CL open, bringing the tool holder into its open configuration. As described above, when the thermally-expandable material in the reservoir is cooled and contracts, the force of primary spring 55 (which bears against surface 51 of moveable body 50) urges moveable body 50 away from the clamp CL. This causes surface 57 (which is defined by flange 355) of the moveable body 50 to bear against surface 33 of the clamp, thus forcing the clamp toward its closed position. This also causes surface 52 of movable body 50 to bear forcibly against surface 64 of movable body 60, which is free (with the material in the reservoir having been cooled and contracted) to move toward (e.g., closer to, into, or further into) the reservoir 73.

The embodiments of FIGS. 6-8 vary in some respects from those of FIGS. 1-5. The clamp shown in FIGS. 6-8 has a relatively simple construction. Here, a moveable body 160 is in communication with thermally-expandable material in a reservoir 173 of the tool holder. When the material in the reservoir expands, the moveable body 160 is forced toward the clamp CL (to the left, as seen in FIGS. 6-8). In these figures, the movable body 160 preferably is a shaft, rod, pin, disk, or another piston-like block. The moveable body 160 has a surface 162 against which the thermally-expandable material bears forcibly when it is heated and expands or is otherwise in a liquid phase. The resulting force on the moveable body 160 causes another surface 164 (which in this case is generally opposed to surface 162) of the moveable body 160 to bear forcibly against the clamp, thus exerting an opening force on the clamp. In more detail, this clamp-opening force results when surface 164 of the moveable body 160 bears forcibly against surface 132 of the clamp, causing the clamp CL to move toward its open position. As noted above, when the thermally-expandable material is cooled and contracts or is otherwise in a solid phase, the force of spring 155 (which is compressed between head 189 of post 180 and surface 251 of clamp CL) moves the clamp toward its closed position. This causes the clamp CL to bear forcibly upon the movable body 160, causing this body 160 to move toward (e.g., closer to, into, or further into) the reservoir 173. In more detail, it preferably is surface 132 of the clamp CL that bears forcibly against surface 164 of the moveable body 160 in the described manner.

FIG. 17 exemplifies a particularly useful embodiment. Here, the tool holder is illustrated as having two clamps CL on opposite sides of a central wall or block of the tool holder. The tool holder, however, can be modified to accommodate clamping on a single side of the tool holder. The tool holder of FIG. 17 can be set-up and used in various ways. As noted above, the tool holder's reservoir 973 can be filled with thermally-expandable material 998 that is in a liquid phase at room temperature, such that each clamp is held in the closed position unless the material 998 in the reservoir is subjected to a cooling step, whereupon it contracts allowing the force of spring 252 to pivot each clamp CL to its open position. Alternatively, the reservoir 973 can be filled with thermally-expandable material 998 that is a solid at room temperature, such that the force of a spring 252 keeps each clamp CL in its open position unless the material 998 in the reservoir is subjected to a heating step that causes the material 998 to expand sufficiently to slide each moveable body 660 away from the reservoir 973 and forcefully against a clamp CL, so as to pivot the clamp CL to its closed position. In cases where two clamps CL are provided on opposite sides of a tool holder, the opening and closing of both clamps can be achieved simultaneously in the manner just described.

Thus, the design shown in FIG. 17 is representative of a class of embodiments wherein a thermally-responsive actuator A is operably coupled to at least two clamps in such a way that both clamps open or close in response to heating or cooling a component of the actuator. In FIG. 17, the actuator A comprises a thermally-expandable material 998, such as a thermally-expandable polymer. This material 998 is preferably disposed in a reservoir 973 bounded (e.g., defined) by a block B of the tool holder. As with other embodiments, the material 998 can be housed inside an insert (e.g., comprising one or more housing walls encapsulating the material) that is mounted in a reservoir, bore, etc. of the tool holder or that is otherwise operably mounted on the tool holder. In such cases, the insert may have at least one slidably moveable wall, block, piston, or extension that moves toward or way from the material 998 when it is heated or cooled during actuation. The thermally-expandable material 998 in FIG. 17 is shown as being in communication with two moveable bodies 660A, 660B, each being adapted to deliver opening force to one of the two illustrated clamps CL. Here, the reservoir 973 has two outlets, each extending away from the reservoir on opposite sides of the reservoir. Thus, the two illustrated moveable bodies 660A, 660B are slidably mounted respectively in two bores extending from opposite sides of the reservoir, such that one end of each moveable body is in communication with the material 998 in the reservoir while the other end of each moveable body is in contact with one of the clamps CL. Thus, when the material 998 is sufficiently heated, it expands and bears forcibly upon on end of each moveable body, causing each moveable body to slide away from the reservoir, which in turn causes the outer end of each moveable body to bear forcibly against the upper end of one of the two clamps CL. This causes each clamp CL to pivot to the closed position. Thus, actuating a single thermally-responsive actuator A (e.g., delivering heat to a single actuator) causes two clamps to simultaneously open or close (e.g., by causing both clamps CL to pivot simultaneously such that two ends PE of the clamps move toward each other). Alternatively, a series (e.g., two or more) of actuators can be operably coupled between two clamps, such that operating a single series of these actuators causes two clamps to simultaneously open or close.

Figure 12:
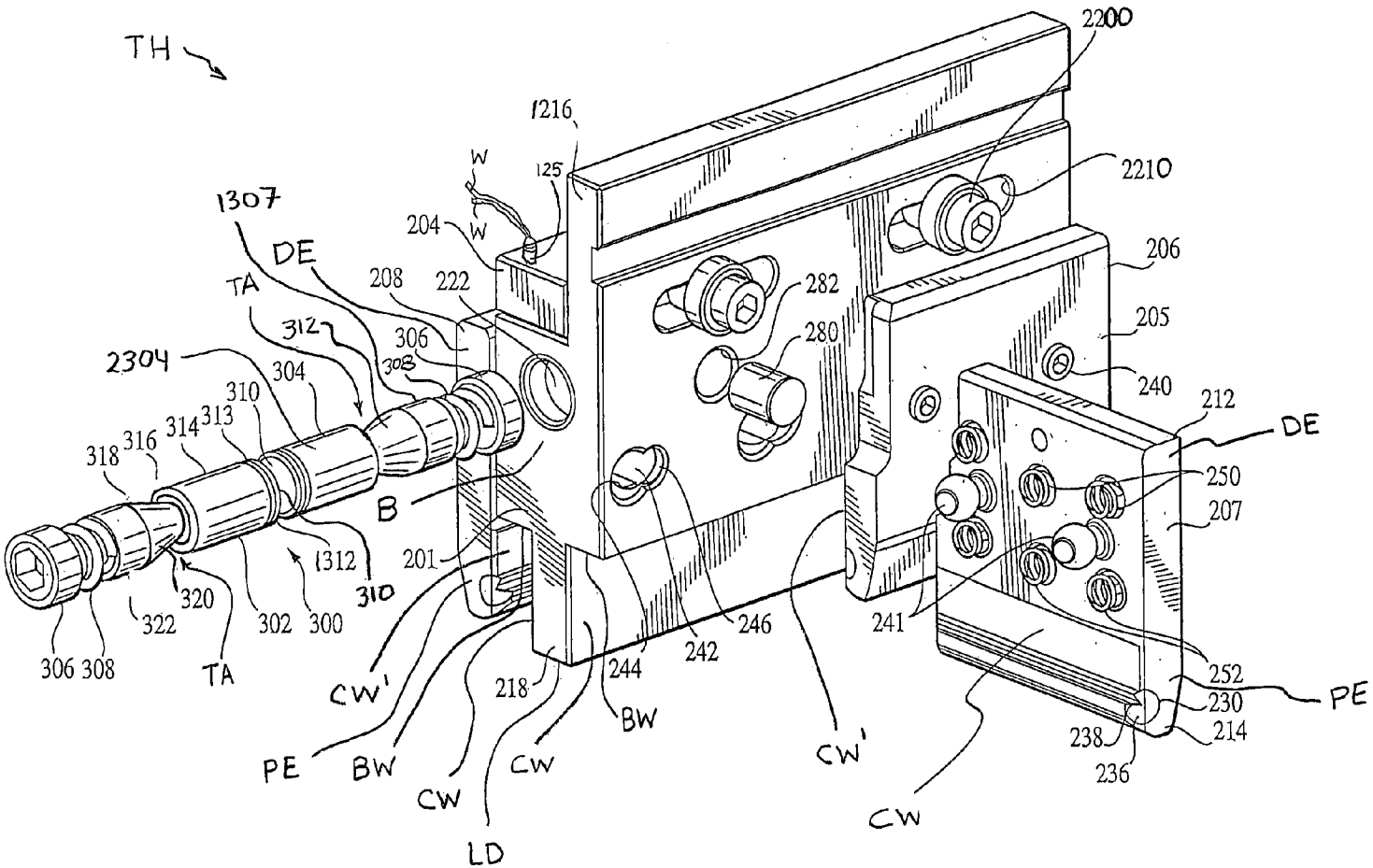
FIG. 12 is a schematic partially-exploded perspective view of a press brake tool holder in accordance with certain embodiments of the invention.
Figure 13:
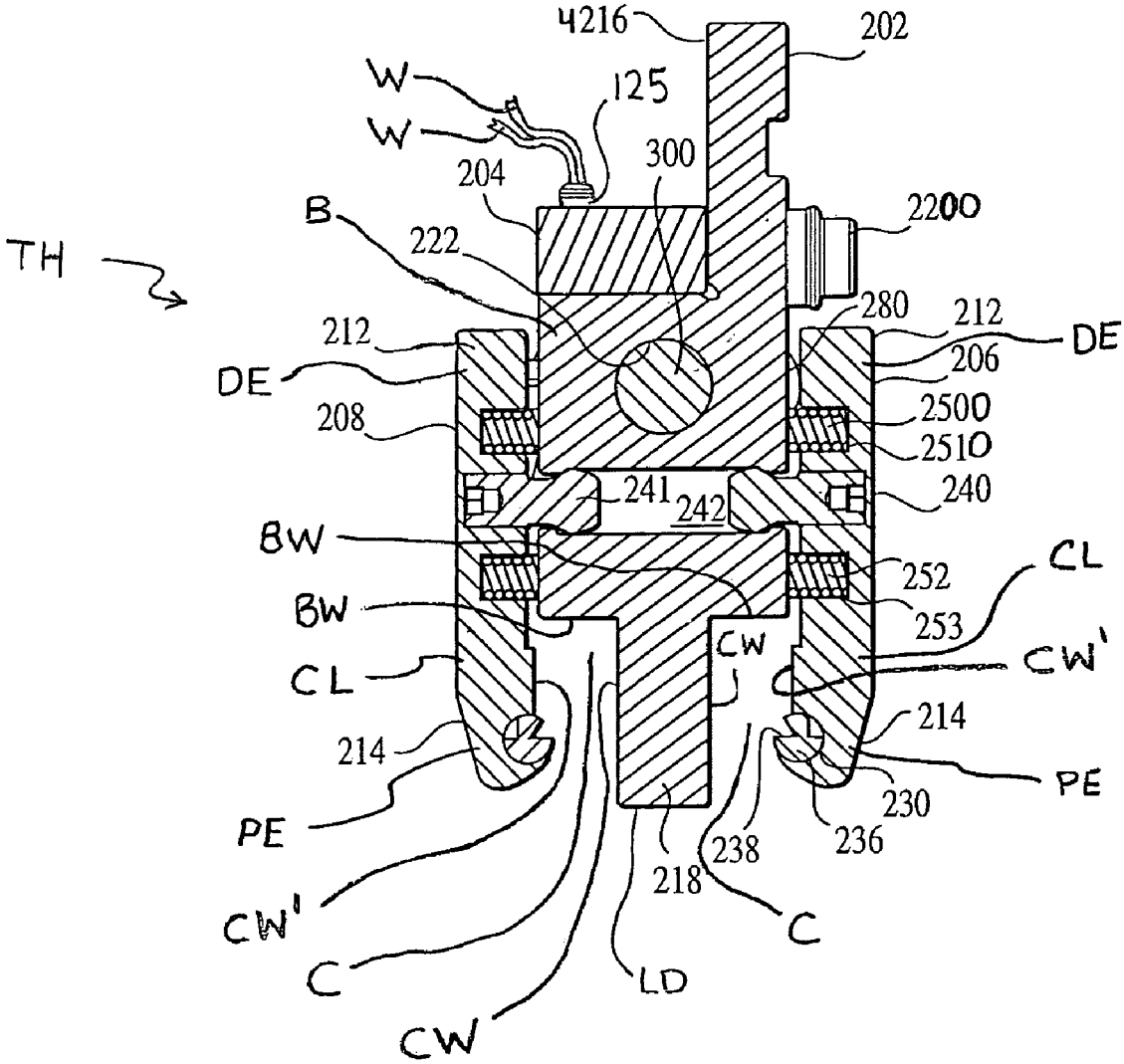
FIG. 13 is a schematic cross-sectional side view of a press brake tool holder in accordance with certain embodiments of the invention.
Figure 14:
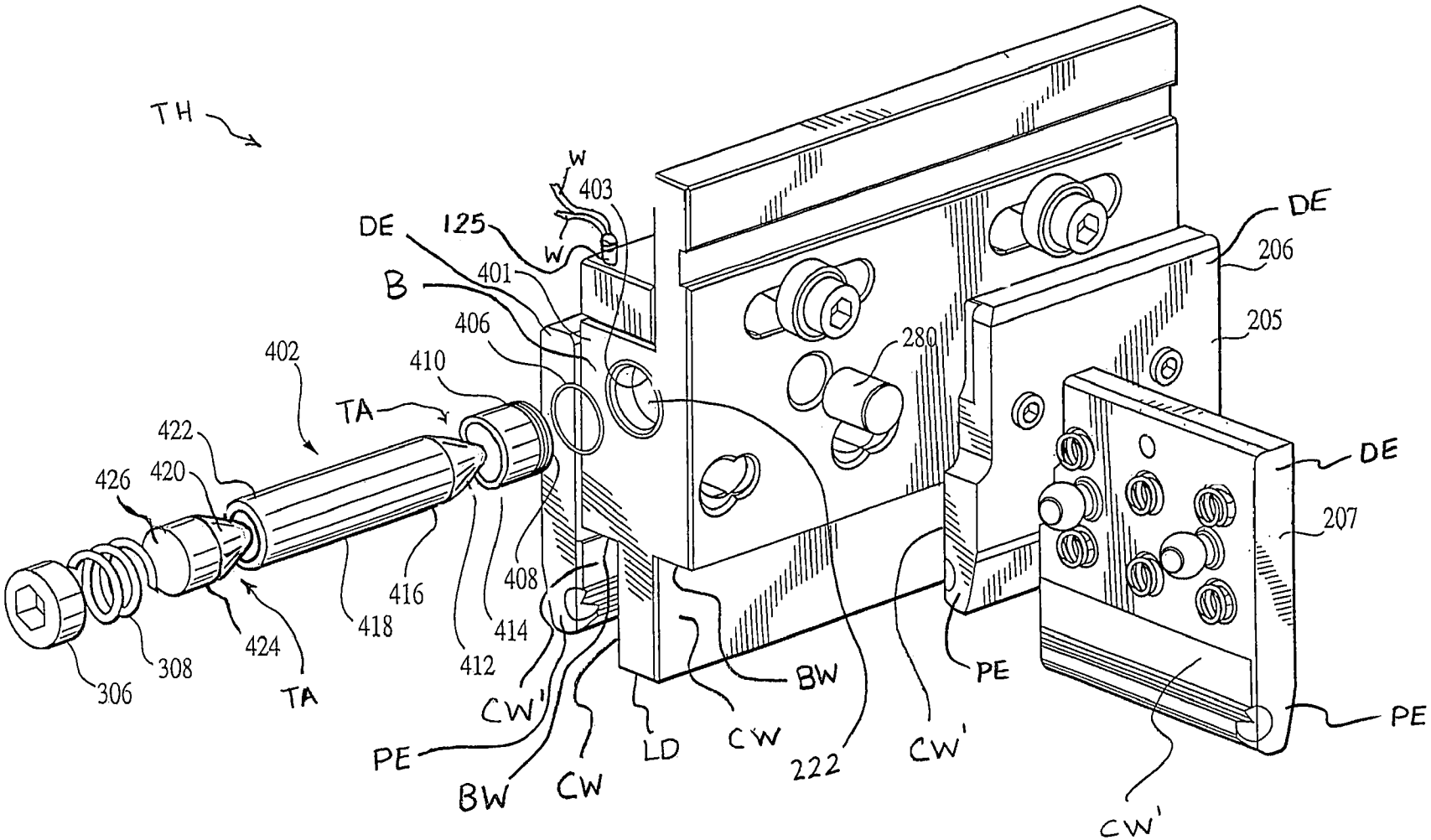
FIG. 14 is a schematic partially-exploded perspective view of a press brake tool holder in accordance with certain embodiments of the invention.
Figure 15:
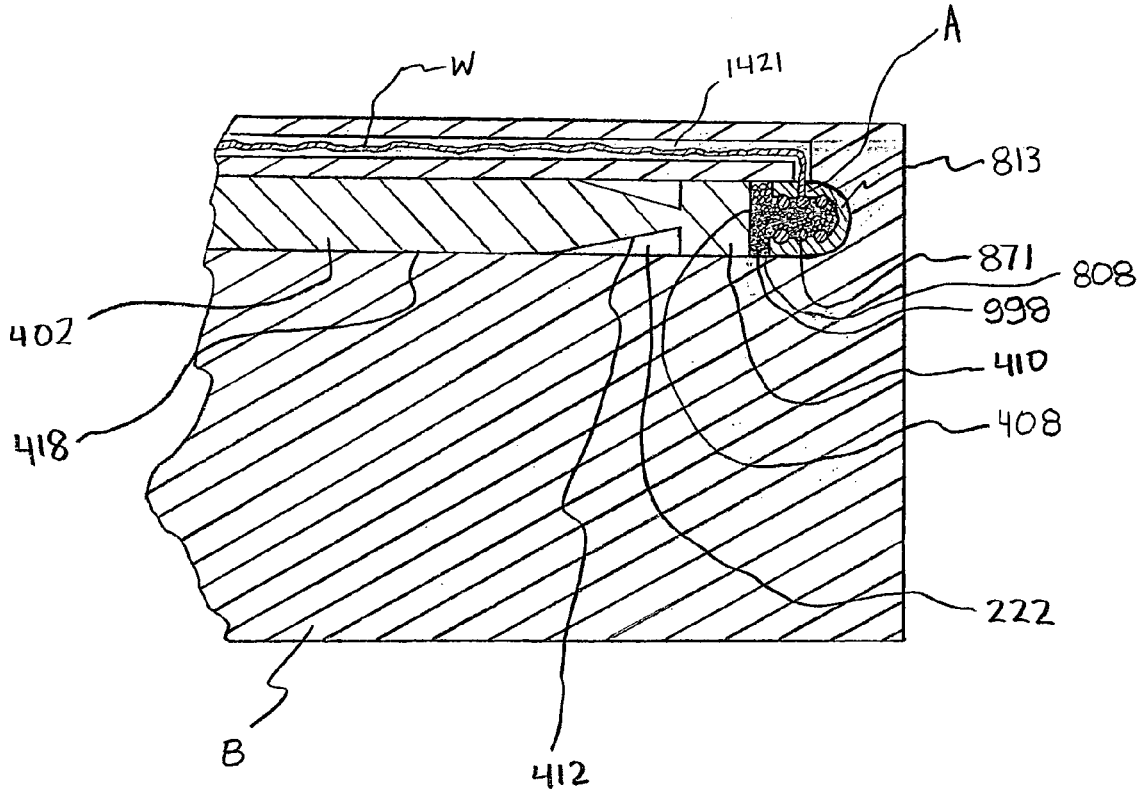
FIG. 15 is a schematic cross-sectional detail side view of a press brake tool holder in accordance with certain embodiments of the invention.
Figure 16:
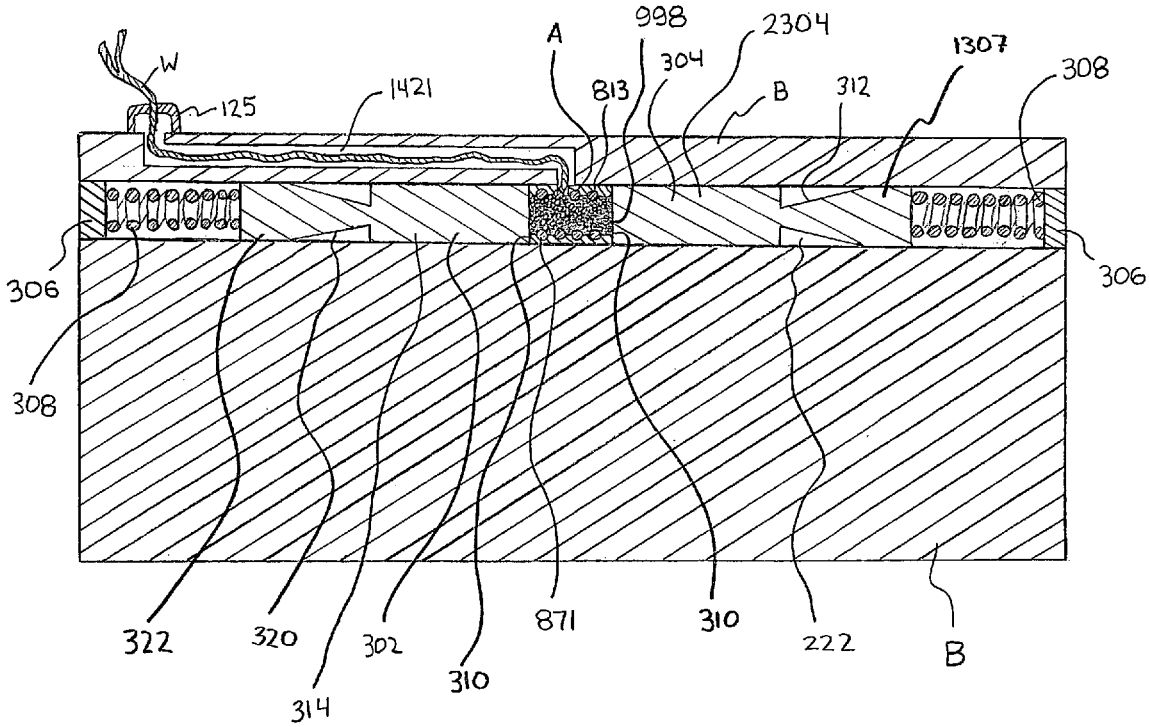
FIG. 16 is a schematic partially broken-away cross-sectional detail side view of a press brake tool holder in accordance with certain embodiments of the invention.

FIGS. 11-16 also exemplify particularly useful embodiments. Here, the tool holder is provided with at least one moveable body 300, 402 mounted (e.g., slidably) for axial movement within a bore 222, which preferably extends longitudinally through a wall or block B of the tool holder. The moveable body 300, 402 preferably comprises (e.g., is) at least one shaft, rod, pin, or block adapted to move (e.g., to slide) axially within the bore 222. While the moveable body 300, 402 and the bore 222 are shown in FIGS. 12 and 14 as being cylindrical, this is not required. Rather, the body 300, 402 can alternatively be rectangular, polygonal, etc. Preferably, the moveable body is adapted to move axially within the bore 222 in response to performing a heating or cooling step on a thermally-responsive actuator A of the tool holder. In the present embodiments, the moveable body has at least one cam surface which, as the body is moved in a first direction, cams with either a clamp of the tool holder or with a moveable follower body that is thereby caused to bear forcibly against the clamp, causing the clamp to move either from its closed position to its open position or from its open position to its closed position. With reference to FIG. 15, an end region 808 of the bore 222 is filled with thermally-expandable material (e.g., polymer) 998. In some such embodiments, the material 998 assumes a solid phase at room temperature, and when heated to a desired elevated temperature, the thermally-expandable material undergoes a solid to liquid phase change, thus expanding and bearing forcibly against one end 408 of the moveable body 402 so as to move (e.g., slide) the body 402 axially (e.g., in a first direction) within the bore 222. In some cases, there is provided a moveable body 300 comprising two moveable shafts 302, 304 mounted (e.g., slidably) in the bore 222 such that when the thermally-expandable material 998 in the bore 222 is heated, it expands and bears forcibly against both moveable shafts 302, 304, causing them both to move axially (e.g., away from each other in preferred embodiments) within the bore 222. FIGS. 12 and 16 are representative of such embodiments and are described below in further detail.

With reference to FIGS. 14-15, the moveable body 402 preferably has at least one cam surface 412, 420. The moveable body here is depicted as being a cam shaft, which desirably is provided with at least one tapered shaft region defining a cam surface. Preferably, the cam shaft is generally or substantially cylindrical and has two tapered shaft regions TA each defining a cam surface 412, 420. In FIGS. 14-15, each illustrated tapered shaft region is bounded on one side by a large-diameter region that tapers axially to a small-diameter region. For example, moving from proximate end region 424 of the cam shaft 402 toward distal end region 410, the cam shaft 402 begins with a large-diameter region at the proximate end region 424, then tapers axially at a first tapered region TA to a small-diameter region, which small-diameter region terminates at a large-diameter region that forms a mid-shaft region 418, and proceeds further to another tapered shaft region TA, which tapers axially to a small-diameter region, which small-diameter region terminates at the beginning of a large-diameter region that forms the distal end region 410 of the shaft 402. Here, the distal end region 410 defines an end surface 408 that is a pressure-bearing surface. It is this surface 408 against which the thermally-expandable material 998 in the bore 222 bears forcibly when it 998 is heated or is otherwise in an expanded state. The proximate end region 424 of the shaft 402 is mounted against a spring member 308 that resiliently biases the shaft 402 axially distally (i.e., toward distal end region 808 of bore 222, in a second direction). Here, the spring member 308 seats against an end cap 306 that is rigidly attached to the wall B of the tool holder, so as to bound the proximate end of the bore 222.

Referring now to FIGS. 12 and 16, there is depicted a tool holder in which the bore 222 has therein mounted two moveable bodies 302, 304. Here, both bodies 302, 304 are moveable axially (e.g., slidably) within the bore 222. Preferably, each moveable body is a cam shaft having at least one tapered shaft region TA. In FIGS. 12 and 16, the illustrated cam shafts 302, 304 are kept in the bore 222 by end caps 306, although various other arrangements can be used (e.g., one end of the bore 222 can be defined by the wall B of the tool holder TH itself, as exemplified in FIG. 15). With continued reference to FIGS. 12 and 16, first cam shaft 302 is biased away from first end cap 306 by a first spring member 308. Likewise, second cam shaft 304 is biased away from second end cap 306 by a second spring member 308. The cam shafts 302, 304 have a gap 1312 between them in which, when the tool holder is operatively assembled, thermally-expandable material (e.g., polymer) 998 is disposed. The two shafts 302, 304 have confronting surfaces 310 against which the thermally-expandable material 998 bears forcibly when it 998 is heated or otherwise expanded. Sealing rings 313 are desirably provided for sealingly containing the material 998. The first cam shaft 302 has a large-diameter end region 322 that abuts a spring member 308, as described above. This proximate end region 322 preferably has a substantially constant diameter, and extends to a tapered region TA from where this large-diameter region 322 tapers axially to a small-diameter region, which small-diameter region terminates at one end of another large-diameter end region 314. This large-diameter region 314 defines the distal end region of the first cam shaft 302 and defines a pressure-bearing surface 310. The pressure-bearing surface 310 of the first cam shaft 302 confronts the pressure-bearing surface 310 of the second cam shaft 304 when the tool holder is operatively assembled (e.g., these pressure-bearing surfaces 310 are desirably on confronting ends of the shafts 302, 304 between which the material 998 is disposed). The pressure-bearing surface 310 of the second shaft 304 is defined by a large-diameter end region 2304, which extends to a tapered region TA. This tapered region, which begins at a small-diameter region and ends at a large-diameter region 1307, preferably has a gradually increasing thickness (moving distally). Large-diameter region 1307 defines the proximate end region of the second shaft and abuts a spring member 308 seated against an end cap 306 rigidly fixed to the tool holder at the distal end of the bore 222.

With continued reference to FIGS. 11-16, each moveable body preferably has at least one cam surface configured for engaging another moveable body (e.g., a cam follower pin or another moveable follower body) 280 that is operably coupled to a clamp such that movement of the body 280 in one direction (e.g., outwardly away from bore 222) forces the clamp into its closed position, and movement of the body 280 in an opposite direction (e.g., inwardly toward bore 222) causes the clamp to be moved to its open position. Here, springs 252 bias each clamp CL toward the open position. Preferably, when each follower body 280 is aligned with a small-diameter region at a tapered region TA of a cam shaft, the springs 252 move each clamp CL pivotally to the open position. Each follower body 280 desirably is adapted to ride on, and cam with, a tapered cam surface of a cam shaft mounted slidably in the bore 222.

In the embodiments of FIGS. 11-16, each moveable body preferably is a cam shaft having a large-diameter region, a small-diameter region, and therebetween a tapered region which preferably is generally or substantially conical. The configuration of a given cam surface, however, can be varied extensively to achieve the desired result.

In certain embodiments, the tool holder includes a plurality of thermally-responsive actuators operably coupled to a clamp of the tool holder such that simultaneous operation of the actuators moves the clamp selectively into either an open position or a closed position. In some embodiments of this nature, each actuator is operated (i.e., actuated) by resistance heating of the actuator, and the multiple actuators are wired electrically in parallel, rather than in series. This is a desirable arrangement in that all of the actuators of the clamp are heated by substantially the same resistance R, each actuator thus being adapted to deliver substantially the same force to the clamp.

Figure 4:
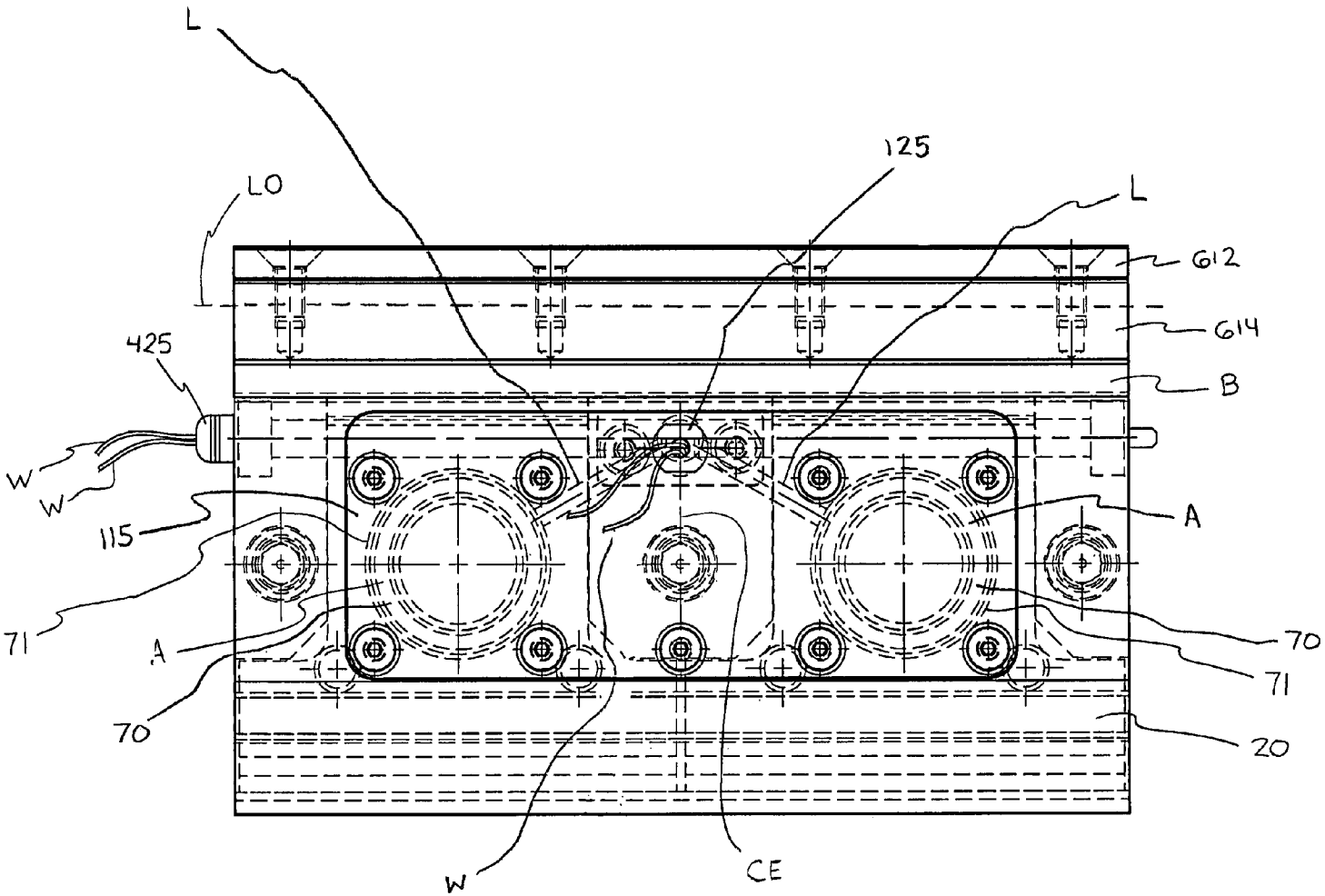
FIG. 4 is a schematic back side view of the tool holder of FIG. 1.
Figure 5:
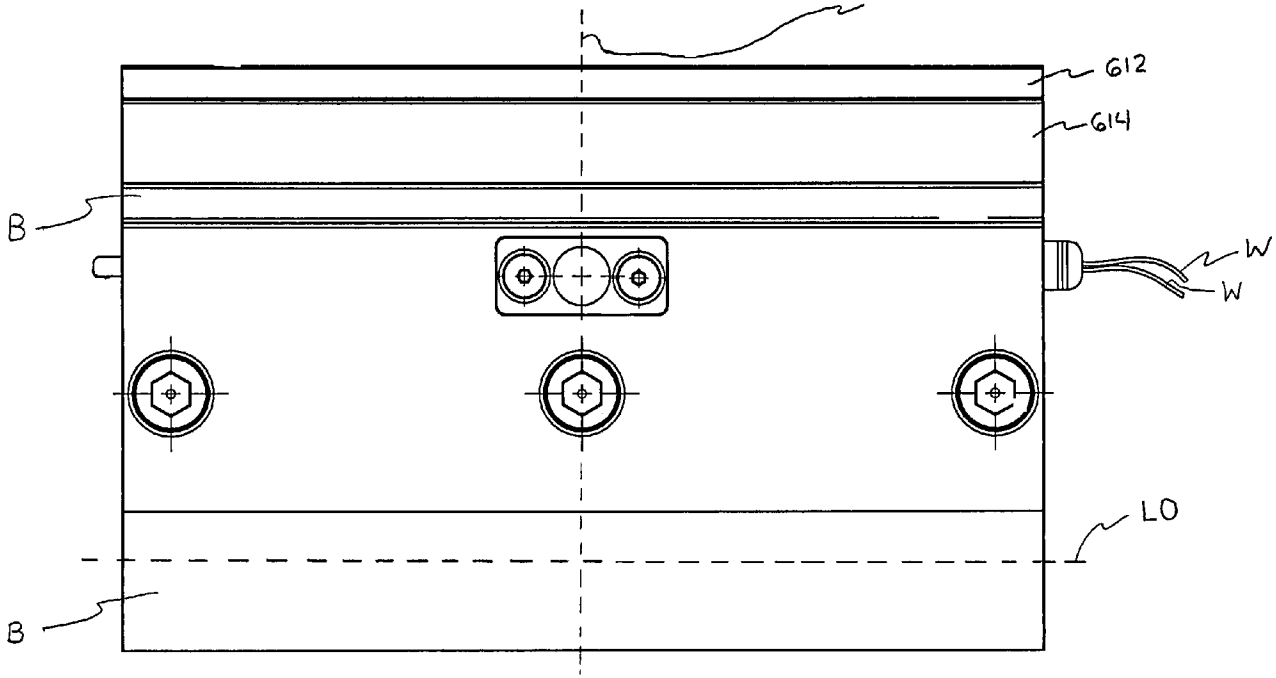
FIG. 5 is a schematic front side view of the tool holder of FIG. 1.

Reference is made to FIG. 4, wherein the illustrated clamp CL is operably coupled to a plurality of thermally-responsive actuators A. In certain embodiments of this nature, the tool holder further includes a plurality of springs applying to the clamp either a clamp-closing force or a clamp-opening force.

The tool holder TH in various embodiments includes a clamp CL, as has been described. In some of these embodiments, the clamp itself carries (e.g., houses) one or more springs adapted for biasing the clamp toward its closed position. Exemplary embodiments of this nature are described and illustrated in the present disclosure.

Finally, a number of clamp embodiments involving a thermally-expandable material have been described. It is to be appreciated that any of the described clamp embodiments can employ one of, or both, a thermally-expandable polymer and a shape-memory alloy.

In certain preferred embodiments, the actuator A is a fast-acting mechanism. That is, it A is adapted to move the tool holder TH between its closed and open configurations relatively quickly, e.g., in about 10 seconds or less, more preferably about 5 seconds or less, and perhaps optimally about 3 seconds or less.

In certain embodiments, the tool holder includes an indicator that generates externally ascertainable information (e.g., ascertainable, preferably visibly, by a human tool holder operator) indicating whether the tool holder is in its open or closed position. Alternatively or additionally, the information generated may indicate the temperature and/or phase of the actuator's thermally-responsive component. For example, the tool holder may comprise a thermometer or another gauge adapted for measuring the temperature of thermally-expandable material in an internal reservoir of the tool holder. The indicator can be operatively coupled to such a temperature gauge and adapted for generating the desired information using temperature data from the gauge as input. Alternatively or additionally, the indicator can include one or more position sensors adapted for determining whether the tool holder is in its closed configuration or its open configuration. In some cases, the optional indicator comprises an externally visible display (i.e., a display visible to an operator), such as an LED, one or more lights that turn on and off selectively, a plurality of lights of different colors that turn on and off selectively, etc. In one embodiment, the tool holder includes at least one light that is adapted to flash when the tool holder is in, or is at least moving toward, its open position. In certain embodiments, the thermally-responsive component of the actuator comprises a material that undergoes a phase change (e.g., a solid-liquid phase change) upon actuation, and the indicator is adapted to display a visual message, sound, or the like indicating which phase the material and/or whether the tool holder is in its open or closed configuration.

The clamping force of the tool holder TH can be controlled in various ways. This can be accomplished in part by selecting from different materials for use in (or as) the thermally-responsive component of the actuator A. In some cases, this can also be accomplished in part by selecting the amount of heat that is delivered to or from the thermally-responsive component during actuation. Another option for controlling the clamping force of the tool holder involves selecting from various different mechanical advantage situations, such as those described above. Further, in cases where the tool holder comprises a moveable body in fluid communication with thermally-expandable material in a reservoir of the tool holder, it may be possible to control the tool holder's clamping force by adjusting the surface area of the moveable body against which the thermally-expandable material bears forcibly during actuation. This may be accomplished by adjusting the size of the reservoir and/or by adjusting the size of the moveable body relative to the size of the reservoir. For purposes of controlling the tool holder's clamping force, embodiments involving a platen or plate-like moveable body may be particularly advantageous, particularly where a major surface of the platen communicates with the thermally-expandable material.

While preferred embodiments of the present invention have been described, it should be understood that a variety of changes, adaptations, and modifications can be made therein without departing from the spirit of the invention and the scope of the appended claims.

What is claimed is:

1. A press brake tool holder and a press brake tool in combination, the press brake tool having generally opposed first and second ends, the first end of the press brake tool defining a workpiece-deforming surface configured for making a predetermined press-brake deformation in a workpiece when the workpiece-deforming surface is forced against the workpiece, the second end of the press brake tool having a tang mounted in a tool-mount channel defined by the tool holder, the tool-mount channel being bounded by two confronting walls of the tool holder, wherein at least one of the confronting walls is adapted to move selectively toward or away from the other confronting wall in response to delivery of heat selectively to or from a thermally-responsive actuator of the tool holder, the tool holder having two horizontal load-delivering surfaces respectively carried directly against two horizontal load-receiving surfaces of the press brake tool, the two horizontal load-delivering surfaces of the tool holder being adapted to deliver force to the two horizontal load-receiving surfaces of the tool, the two horizontal load-delivering surfaces of the tool holder being on opposite sides of the channel such that they are separated by an opening of the channel, the two horizontal load-delivering surfaces of the tool holder lying in a common horizontal plane, at least one of said confronting walls comprising a pivotable clamp, the clamp having a pivot point located at a distal end of the clamp, the clamp being adapted to pivot selectively into either an open position or a closed position in response to delivery of heat selectively to or from a thermally-responsive component of the actuator.

2. The tool holder and tool combination of claim 1 wherein the tool holder is adapted for forcing the workpiece-deforming surface of the press brake tool against the workpiece by delivering force from the load-delivering surfaces of the tool holder to the load-receiving surfaces of the press brake tool.

3. The tool holder and tool combination of claim 2 wherein the tool holder is adapted for moving the press brake tool in a direction generally normal to the load-delivering surfaces of the tool holder.

4. The tool holder and tool combination of claim 3 wherein the tool holder is adapted for moving the press brake tool in a generally vertical direction.

5. The tool holder and tool combination of claim 1 wherein the tang of the press brake tool has a safety key projecting away from the tang and engaging a safety recess defined by the tool holder, such that an engagement portion of the safety key is received in the tool holder's safety recess.

6. The tool holder and tool combination of claim 1 wherein the tool holder is adapted to move selectively into either a closed configuration or an open configuration in response to delivery of heat selectively to or from a thermally-responsive component of the actuator.

7. The tool holder and tool combination of claim 6 wherein the thermally-responsive component of the actuator comprises a thermally-expandable polymer or a shape-memory alloy.

8. The tool holder and tool combination of claim 7 wherein the thermally-responsive component of the actuator comprises a thermally-expandable polymer that expands and contracts, respectively, upon being heated and cooled.

9. The tool holder and tool combination of claim 6 wherein the actuator comprises a reservoir in which the thermally-responsive component is contained.

10. The tool holder and tool combination of claim 6 wherein the actuator comprises a heat-transfer element for delivering heat to and/or from the thermally-responsive component of the actuator.

11. The tool holder and tool combination of claim 10 wherein the heat-transfer element comprises one or more heat-transfer coils.

12. The tool holder and tool combination of claim 1 wherein the clamp is operably coupled to a movable body in communication with the thermally-responsive component of the actuator such that when the thermally-responsive component is heated or cooled so as to expand or contract, resulting movement of the movable body causes the clamp to move toward either its open position or its closed position.

13. The tool holder and tool combination of claim 12 wherein said resulting movement forces the moveable body either directly against the clamp or against another moveable body that is thereby forced against the clamp.

14. The tool holder and tool combination of claim 1 wherein the clamp is disposed between an outer wall of the tool holder and an inner wall of the tool holder.

15. The tool holder and tool combination of claim 14 wherein said inner and outer walls of the tool holder are stationary walls.

16. The tool holder and tool combination of claim 14 wherein the clamp is resiliently biased toward its closed position by at least one primary spring member.

17. The tool holder and tool combination of claim 1 wherein the tool holder includes a plurality of thermally-responsive actuators operably coupled to the clamp of the tool holder such that simultaneous operation of the actuators moves the clamp selectively into either an open position or a closed position.

18. The tool holder and tool combination of claim 17 wherein the tool holder includes a plurality of springs biasing the clamp selectively toward either its open position or its closed position.

19. The tool holder and tool combination of claim 1 further including an indicator adapted to generate externally ascertainable information indicating whether the tool holder is in a closed or open position.

20. The tool holder and tool combination of claim 1 wherein the thermally-responsive actuator is a fast-acting mechanism adapted to move the tool holder between closed and open configurations in 5 seconds or less.

21. A press brake tool holder and a press brake tool in combination, the press brake tool having generally opposed first and second ends, the first end of the press brake tool defining a workpiece-deforming surface configured for making a predetermined press-brake deformation in a workpiece when the workpiece-deforming surface is forced against the workpiece, the second end of the press brake tool having a tang mounted in a tool-mount channel defined by the tool holder, the tool-mount channel being bounded by two confronting walls of the tool holder, wherein at least one of the confronting walls is adapted to move selectively toward or away from the other confronting wall in response to delivery of heat selectively to or from a thermally-responsive actuator of the tool holder, the tool holder having a load-delivering surface engaged with a load-receiving surface of the press brake tool, wherein at least one of said confronting walls is defined by a clamp of the tool holder, the clamp being adapted to move selectively into either an open position or a closed position in response to delivery of heat selectively to or from a thermally-responsive component of the actuator, wherein the clamp is mounted on a wall of the tool holder such that the clamp is moveable pivotally about a pivot point, the clamp being under a constant clamp-closing force and being adapted to receive a clamp-opening force in response to one of heating or cooling the thermally-responsive component of the actuator, the clamp-opening force being delivered to the clamp at a first location on the clamp, the clamp-closing force being delivered to the clamp at a second location on the clamp, said first location being further from said pivot point than is said second location such that the clamp-opening force has mechanical advantage over the clamp-closing force.

22. A press brake tool holder and a press brake tool in combination, the press brake tool having generally opposed first and second ends, the first end of the press brake tool defining a workpiece-deforming surface configured for making a predetermined press-brake deformation in a workpiece when the workpiece-deforming surface is forced against the workpiece, the second end of the press brake tool having a tang mounted in a tool-mount channel defined by the tool holder, the tool-mount channel being bounded by two confronting walls of the tool holder, wherein at least one of the confronting walls is adapted to move selectively toward or away from the other confronting wall in response to delivery of heat selectively to or from a thermally-responsive actuator of the tool holder, the tool holder having a load-delivering surface engaged with a load-receiving surface of the press brake tool, wherein the tool holder comprises a clamp disposed between an outer wall of the tool holder and an inner wall of the tool holder, wherein the clamp defines one of said confronting walls of the tool holder and is moveable between an open position and a closed position, wherein the clamp is mounted pivotally between said inner and outer walls of the tool holder, such that the clamp is moveable pivotally between its open position and its closed position.

23. The tool holder and tool combination of claim 22 further including an indicator adapted to generate externally ascertainable information indicating whether the tool holder is in a closed or open position.

24. The tool holder and tool combination of claim 22 wherein the thermally-responsive actuator is a fast-acting mechanism adapted to move the tool holder between closed and open configurations in 5 seconds or less.

25. A press brake tool holder and a press brake tool in combination, the press brake tool having generally opposed first and second ends, the first end of the press brake tool defining a workpiece-deforming surface configured for making a predetermined press-brake deformation in a workpiece when the workpiece-deforming surface is forced against the workpiece, the second end of the press brake tool having a tang mounted in a tool-mount channel defined by the tool holder, the tool-mount channel being bounded by two confronting walls of the tool holder, wherein at least one of the confronting walls is adapted to move selectively toward or away from the other confronting wall in response to delivery of heat selectively to or from a thermally-responsive actuator of the tool holder, the tool holder having a load-delivering surface engaged with a load-receiving surface of the press brake tool, wherein the tool holder comprises a clamp disposed between an outer wall of the tool holder and an inner wall of the tool holder, wherein the clamp defines one of said confronting walls of the tool holder and is moveable between an open position and a closed position, wherein the clamp is resiliently biased toward its closed position by at least one primary spring member, wherein the tool holder includes at least one moveable body that is moveable between a first position in which the moveable body retains the clamp in its closed position and a second position in which the moveable body does not prevent the clamp from being moved to its open position, the moveable body being in communication with a thermally-responsive component of the actuator, such that delivery of heat to the thermally-responsive component of the actuator causes the moveable body to move into its second position, whereupon at least one secondary spring member bearing upon the clamp causes the clamp to move to its open position.

26. The tool holder and tool combination of claim 25 wherein the moveable body is slidable between its first position and its second position, such that delivery of heat to the thermally-responsive component of the actuator causes the moveable body to slide from its first position to its second position.

27. The tool holder and tool combination of claim 25 wherein the moveable body is disposed between the primary spring member and the thermally-responsive component of the actuator, wherein the primary spring member resiliently biases the moveable body in a first direction, and wherein the thermally-responsive component of the actuator when heated biases the moveable body in a second direction, said first and second directions being generally opposite directions.

28. The tool holder and tool combination of claim 27 wherein two moveable bodies are disposed between the primary spring member and the thermally-responsive component of the actuator.

29. A method of operating a press brake tool holder, the method comprising providing, in combination, the press brake tool holder and a press brake tool, wherein the press brake tool has generally opposed first and second ends, the first end of the press brake tool defining a workpiece-deforming surface configured for making a predetermined press-brake deformation in a workpiece when the workpiece-deforming surface is forced against the workpiece, the second end of the press brake tool having a tang mounted in a tool-mount channel defined by the tool holder, the tool-mount channel being bounded by two confronting walls of the tool holder, the tool holder having two horizontal load-delivering surfaces adapted to deliver force to two horizontal load-receiving surfaces of the tool, the two horizontal load-delivering surfaces of the tool holder being on opposite sides of the channel such that they are separated by an opening of the channel, the two horizontal load-delivering surfaces of the tool holder lying in a common horizontal plane, wherein at least one of the confronting walls comprises a clamp that is adapted to move toward the other confronting wall in response to delivery of heat selectively to or from a thermally-responsive actuator of the tool holder, the tool holder including a clamp-opening spring that constantly biases the clamp toward an open position, such that the clamp is constantly spring biased toward its open position, and wherein actuating the thermally-responsive actuator causes the clamp to move to a closed position, the method comprising delivering heat selectively to or from the thermally-responsive actuator of the tool holder so as to cause the clamp to overcome the bias of said spring and move toward the other confronting wall until the clamp reaches its closed position.

30. A press brake tool holder and a press brake tool in combination, the tool holder having a tool-mount channel in which a tang of the press brake tool is mounted, the tool holder having two generally horizontal load-bearing surfaces engaged respectively with two generally horizontal load-bearing surfaces of the press brake tool, the two horizontal load-delivering surfaces of the tool holder being on opposite sides of the channel such that they are separated by an opening of the channel, the two horizontal load-delivering surfaces of the tool holder lying in a common horizontal plane, wherein the tool holder is adapted for forcing a tip of the press brake tool against a workpiece by delivering force from the generally horizontal load-bearing surface of the tool holder to the generally horizontal load-bearing surface of the press brake tool, the tool-mount channel being bounded by two confronting walls of the tool holder, wherein at least one of the confronting walls comprises a clamp that is adapted to move toward the other confronting wall in response to delivery of heat selectively to or from a thermally-responsive component of the actuator, the tool holder including a clamp-opening spring that constantly biases the clamp toward an open position, such that the clamp is constantly spring biased toward its open position, and wherein actuating the thermally-responsive actuator causes the clamp to move to a closed position, wherein the thermally-responsive component of the actuator comprises a thermally-expandable polymer and/or a shape-memory alloy.

31. The tool holder and tool combination of claim 30 wherein the tool holder is adapted for moving the press brake tool in a generally vertical direction.

32. A method of operating a press brake tool holder, the method comprising providing, in combination, the press brake tool holder and a press brake tool, the tool holder having a tool-mount channel in which a tang of the press brake tool is mounted, the tool holder having two horizontal load-bearing surfaces respectively carried directly against two horizontal load-bearing surfaces of the press brake tool, the two horizontal load-delivering surfaces of the tool holder being adapted to deliver force to the two horizontal load-receiving surfaces of the tool, the two horizontal load-delivering surfaces of the tool holder being on opposite sides of the channel such that they are separated by an opening of the channel, the two horizontal load-delivering surfaces of the tool holder lying in a common horizontal plane, the tool-mount channel being bounded by two confronting walls of the tool holder, wherein at least one of the confronting walls comprises a pivotable clamp that is adapted to pivot toward the other confronting wall in response to delivery of heat selectively to or from a thermally-responsive component of the actuator, the clamp having a pivot point located at a distal end of the clamp, wherein the thermally-responsive component of the actuator comprises a thermally-expandable polymer and/or a shape-memory alloy, the method comprising forcing a tip of the press brake tool against a workpiece by delivering force from the horizontal load-bearing surfaces of the tool holder to the horizontal load-receiving surfaces of the press brake tool.

33. The method of claim 32 wherein the tip of the press brake tool is forced against the workpiece by operating the tool holder so as to move the press brake tool in a direction generally normal to the load-bearing surfaces of the tool holder, such that the tip of the press brake tool is brought to bear forcibly against the workpiece.

34. The method of claim 33 wherein the tool holder moves the press brake tool in a generally vertical direction.

35. A press brake tool holder having a plurality of thermally-responsive actuators, the tool holder having a tool-mount channel bounded by two confronting walls of the tool holder, wherein at least one of the confronting walls comprises a clamp that moves selectively toward or away from the other confronting wall in response to delivery of heat selectively to or from said plurality of thermally-responsive actuators, the plurality of actuators all being operably coupled to said single clamp such that simultaneous operation of the actuators moves the clamp selectively into either an open position or a closed position, wherein the press brake tool holder has an internal chamber in which the thermally-responsive component of the actuator is disposed, the thermally-responsive component comprising a thermally-expandable polymer and/or a shape-memory alloy.

36. The tool holder of claim 35 wherein the tool holder includes a plurality of springs applying to said single clamp a constant biasing force selected from the group consisting of a clamp-closing force and a clamp-opening force.

37. The tool holder of claim 35 further including an indicator adapted to generate externally ascertainable information indicating whether the tool holder is in a closed or open position.

38. The tool holder of claim 37 wherein the indicator comprise an externally visible display.

* * * * *